US007190928B2

(12) United States Patent
Miyakawa et al.

(10) Patent No.: US 7,190,928 B2
(45) **Date of Patent: *Mar. 13, 2007**

(54) IMAGE-FORMING APPARATUS EMPLOYING WORK FUNCTION RELATIONSHIPS

(75) Inventors: Nobuhiro Miyakawa, Nagano (JP); Mikio Furumizu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 227 days.

This patent is subject to a terminal disclaimer.

(21) Appl. No.: 10/762,497

(22) Filed: Jan. 23, 2004

(65) Prior Publication Data

US 2004/0218948 A1 Nov. 4, 2004

(30) Foreign Application Priority Data

Jan. 24, 2003 (JP) ..... P.2003-016521
Jan. 30, 2003 (JP) ..... P.2003-022705

(51) Int. Cl.
*G03G 15/01* (2006.01)

(52) U.S. Cl. ..... 399/302

(58) Field of Classification Search ..... 399/302, 399/308

See application file for complete search history.

(56) References Cited

U.S. PATENT DOCUMENTS

| | | | | |
|---|---|---|---|---|
| 5,753,396 | A * | 5/1998 | Nakamura et al. | 430/101 |
| 6,819,899 | B2 * | 11/2004 | Miyakawa et al. | 399/252 |
| 2004/0265714 | A1 * | 12/2004 | Miyakawa et al. | 430/45 |

FOREIGN PATENT DOCUMENTS

| | | | |
|---|---|---|---|
| EP | 1271251 A | * | 1/2003 |
| JP | 3-62072 A | | 3/1991 |
| JP | 5-27548 A | | 2/1993 |
| JP | 5-53482 A | | 3/1993 |
| JP | 6-194943 A | | 7/1994 |
| JP | 8-146652 A | | 6/1996 |
| JP | 8-248779 A | | 9/1996 |
| JP | 9-62030 A | | 3/1997 |
| JP | 9-152791 A | | 6/1997 |
| JP | 9-230714 A | | 9/1997 |
| JP | 101207164 A | | 8/1998 |
| JP | 11-181311 A | | 7/1999 |
| JP | 11-218957 A | | 8/1999 |
| JP | 11-231692 | * | 8/1999 |
| JP | 11-249452 A | | 9/1999 |
| JP | 2000-75541 A | | 3/2000 |
| JP | 2000-206755 A | | 7/2000 |
| JP | 2001-92208 A | | 4/2001 |
| JP | 2001-166605 | * | 6/2001 |
| JP | 2002-31933 A | | 1/2002 |
| JP | 2002-49190 A | | 2/2002 |
| JP | 2002-116599 A | | 4/2002 |
| JP | 2002-131973 A | | 5/2002 |
| JP | 2002-174934 A | | 6/2002 |
| JP | 2002-278159 A | | 9/2002 |

* cited by examiner

*Primary Examiner*—Sandra L. Brase
(74) *Attorney, Agent, or Firm*—Sughrue Mion, PLLC

(57) ABSTRACT

The invention provides an image-forming apparatus comprising: at least one latent image holding member on which an electrostatic latent image is to be formed; developing devices having toners of different colors for developing the electrostatic latent image on the latent image holding member to form a toner image; and an intermediate transfer medium onto which the thus formed toner image is to be transferred, wherein the intermediate transfer medium has a work function smaller than or equal to the work function of each of the toners.

22 Claims, 6 Drawing Sheets

IMAGE-FORMING APPARATUS EMPLOYING WORK FUNCTION RELATIONSHIPS

FIELD OF THE INVENTION

The present invention relates to an image-forming apparatus. More particularly, the invention relates to an image-forming apparatus in which toners of different colors are used to successively form toner images on one or more image holding members and the images are transferred to an intermediate transfer medium with application of a transfer voltage and then to a recording medium such as paper.

BACKGROUND OF THE INVENTION

Known image-forming apparatus have a photoreceptor drum or photoreceptor belt (hereinafter referred to as photoreceptor) as a latent image holding member rotatably supported in the main body of the image-forming apparatus. When the apparatus are operated for image formation, an electrostatic latent image is formed in the photosensitive layer of the photoreceptor and this latent image is made visible with a developer by a developing device and then transferred to a recording medium by corona transfer or with a transfer roller, transfer drum, or transfer belt (hereinafter referred to as intermediate transfer medium).

In full-color image-forming apparatus, two or more photoreceptors and developing devices are used to successively transfer images of two or more colors to a recording medium, e.g., paper, on an intermediate transfer medium or the photoreceptors so as to be superposed thereon and the images transferred are fixed. The apparatus operating in this manner are known as tandem machines. Also known is an intermediate transfer system in which color images are successively transferred firstly to an intermediate transfer medium and the images thus transferred are secondly transferred en bloc to a receiving material.

(1) A cleaner-less system is known in which toner residues remaining on the photoreceptors are removed simultaneously with development.

Furthermore, a technique for improving transfer efficiency is known. In this technique, photoreceptors and a transfer medium are rotated or circulated at different speeds to thereby improve toner releasability, resulting in an increased transfer efficiency. In development with a one-component toner, the toner supplied onto a development roller is spread with a regulation blade so as to form a thin film thereon as evenly as possible in order to impart sufficient frictional charges to the toner. The toner is thus negatively charged with the surface of the development roller and the surface of an edge of the regulation blade.

For the case of using an intermediate transfer medium, a technique for preventing the intermediate transfer medium from being fouled by toners has been proposed. Specifically, it has been proposed to use a toner and transfer medium wherein the work function of the toner $\Phi_T$ and the work function of the surface of the transfer medium $\Phi_R$ satisfy the relationship $|\Phi_T-\Phi_R|\leqq 4.0$ (eV) to thereby prevent the transfer medium surface from being fouled by the toner (see, for example, patent document 1). Furthermore, a technique for improving transfer efficiency has been proposed which employs an intermediate transfer medium having such surface properties that it has a contact angle with water of 70° or larger and is more positive in frictional electrification rank than a toner. Due to such surface properties, the intermediate transfer medium has enhanced toner releasability and the Coulomb force exerted between the intermediate transfer medium and the toner is reduced, whereby a satisfactory image free from blind spots can be obtained (see, for example, patent document 2).

However, when used for development with toners of different colors and transfer of the color images, those techniques have been insufficient in preventing color mixing of the toners.

On the other hand, particle size reduction in toners has had a drawback that since it reduces toner flowability, electrification by friction with the development roller surface and with the regulation blade becomes difficult and, as a result, sufficient charges cannot be imparted. Because of this, the toner comes to have a charge amount distribution. It is unavoidable that even a toner for negative electrification gives a positively charged toner. As a result, fog occurs in nonimage areas on the photoreceptor.

A technique for diminishing fog is known which comprises using an elevated regulation pressure in development with a nonmagnetic one-component toner. However, toner overcharge occurs and this tends to result in a reduced toner concentration in development or a reduced transfer efficiency. A technique for overcoming this problem is known in which the amount of a toner attached to the development roller after regulation is adjusted to a value within a proper range (i.e., $w/\rho$ is from 0.2 to 0.8, wherein w is the toner coat amount (mg) per $cm^2$ of the toner support surface and $\rho$ is the true density of the toner ($g/cm^3$)) (see, for example, patent document 3, patent document 4, and patent document 5). However, it has been difficult to prevent fog and reverse toner transfer.

A method of full-color image formation has been proposed in which toners having a small particle diameter are used and the maximum amount of each of the toners of respective colors to be deposited on a receiving material is regulated to 5.0 $g/m^2$ or smaller in order to improve electrification characteristics and to reduce graininess for image quality improvement (see, for example, patent document 6). However, this technique was found to be insufficient in the prevention of reverse toner transfer although effective in improving suitability for low-temperature fixing in which toners are thermally fixed evenly.

Furthermore, a method of full-color image formation has been proposed which comprises forming electrostatic latent images on image holding members (photoreceptors), developing the latent images with charged color toners of yellow, magenta, and cyan and with a black toner, transferring the developed images to an intermediate transfer medium having an electrical resistance of from $10^8$ to $10^{12}$ $\Omega\cdot cm$, subsequently superposing the image developed with the black toner on the intermediate transfer medium to conduct first transfer, and then transferring the toner images to another transfer medium to conduct second transfer (see, for example, patent document 7).

There is a description in that patent document to the effect that the intermediate transfer medium is not electrified by repetitions of the first transfer and the transfer efficiency of the black toner, which is finally deposited for development and subjected to first transfer, is increased. However, this prior-art technique is insufficient in the prevention of reverse toner transfer.

An apparatus for color image formation has also been proposed in which a black toner is first deposited for development and color toners of yellow, magenta, and cyan are deposited thereafter for development to thereby prevent the black toner from undergoing color mixing with any of the other color toners and enable the black toner only to be recycled (see, for example, patent document 8). However, this apparatus has been insufficient in the prevention of reverse toner transfer.

Another apparatus for color image formation has been proposed. In this apparatus, toner images are formed on both sides of a receiving material through an intermediate transfer medium, and color toner images of yellow, magenta, cyan, and black are superposed in such sequence that cyan and black are transferred first and last, respectively, and yellow and magenta are transferred between these (see, for example, patent document 9). However, this apparatus has been insufficient in the prevention of reverse toner transfer with respect to each of the toner layers.

It has been proposed to use a constant-voltage power source for a first-transfer part and a constant-current power source for a second-transfer part (see, for example, patent document 10). However, this technique also has been insufficient in the transfer efficiency of toner layers and in the prevention of reverse toner transfer.

A tandem image-forming apparatus of the toner recycle type having two or more image holding members and two or more developing devices is known in which toners are recovered by cleaning from the image holding members and returned to the developing devices for respective colors (see, for example, patent document 11 and patent document 12). However, this apparatus has been insufficient because considerable fog occurs and the amount of toners transferred reversely is large.

An image-forming apparatus likewise employing a tandem mechanism has been proposed in which development and cleaning are simultaneously conducted in each developing device (see, for example, patent document 13 and patent document 14). This technique enables size reduction in image-forming apparatus. However, the proposed apparatus has been still insufficient in increasing the transfer efficiency to thereby prevent image fog and reverse toner transfer.

It has further been proposed to use spherical toners to conduct non-contact development and thereby eliminate the necessity of a cleaner (see, for example, patent document 15).

In this proposed technique, toners having a roundness of 0.96 or higher are used to realize a high transfer efficiency, and the toners remaining in a slight amount on the photoreceptors are first recovered with holding rollers and thereafter transferred to an intermediate transfer medium to conduct cleaning. However, since the holding rollers are used for preventing toner color mixing, this technique is disadvantageous from the standpoint of reducing the sizes of members to be disposed around the photoreceptors. The image-forming apparatus according to this technique hence has a large width.

Furthermore, a technique has been proposed in which a spherical toner comprising a combination of a toner having a roundness of from 0.950 to 0.995 with silica, alumina, and titania is used in combination with magnetic brush development to simultaneously conduct the development and cleaning in a development part (see, for example, patent document 16). However, this technique has failed to prevent reverse toner transfer.

(2) In the process for color image formation in which toner images are transferred to an intermediate transfer medium, subsequently transferred en bloc to a recording medium such as paper, and then fixed thereon, there have been troubles that a transfer failure occurs to form a vermiculate image and that toner scattering occurs, resulting in poor image reproducibility. A technique for eliminating these troubles has been proposed in which toners are deposited for development in ascending order of charge amount (see, for example, patent document 17).

A technique for forming images with satisfactory color reproducibility has been proposed in which a transfer voltage is selected so that the toner image to be formed as the lowermost layer among toner images successively formed on an intermediate transfer medium can be transferred at an increased transfer efficiency (see, for example, patent document 18).

With respect to an image-forming apparatus in which a receiving material bearing a color image on each side is processed to fix the toner images en bloc, it has been proposed to form toner images on an intermediate transfer medium in such sequence that cyan and black are deposited first and last, respectively, and yellow and magenta are deposited therebetween (see, for example, patent document 9). Furthermore, a technique has been proposed in which when toners of three colors, i.e., yellow, cyan, and magenta, are superposed to form an image on an intermediate transfer medium, that one of the cyan and magenta toners which is deposited earlier contains a larger amount of a flowability-imparting agent and the absolute value of toner charge amount is increased to thereby obtain an image free from defects caused by transfer failures, such as toner scattering, blind spots, uneven image surfaces, and fog (see, for example, patent document 19).

However, none of the techniques described above has succeeded in sufficiently eliminating failures in transfer from the intermediate transfer medium, etc.

A technique for eliminating transfer failures occurring in transfer from an intermediate transfer medium to a recording medium at the nip between these has been proposed. In this technique, a transfer roller to which a transfer bias is applied is disposed on the back side of the intermediate transfer belt, to which toner images are to be transferred from the photoreceptor, in a position located downstream from and close to the region where the intermediate transfer belt is in contact with the photoreceptor (see, for example, patent document 20). However, this technique has been insufficient in the efficiency of transfer of images of superposed toners of three colors.

Furthermore, a method of image formation with an intermediate transfer medium has been proposed in which a constant-voltage power source and a constant-current power source are used for a first-transfer part and a second-transfer part, respectively, to thereby stabilize the efficiency of transfer of toner images of all colors (see, for example, patent documents 21 and 10). However, this technique has been still insufficient in increasing the efficiency of transfer of images made up of superposed toners of three colors.

On the other hand, intermediate transfer media are made of, e.g., a conductive rubber composition having a given volume resistivity. Too low volume resistivities result in current leakage and in problems concerning images formation, such as paper soils. On the other hand, use of intermediate transfer media having a volume resistivity exceeding a given value results in a poor transfer efficiency and, hence, such transfer media are unsuitable for practical use.

Conductive belts formed from a conductive rubber composition obtained by incorporating a carbon black as an electronic-conductivity-imparting agent into a base material such as a rubber or plastic have been used as intermediate transfer media.

However, such intermediate transfer media, in which electrical conductivity is regulated by the addition of an electronic-conductivity-imparting agent, have had a problem that even a slight change in the amount of the electronic-conductivity-imparting agent or uneven distribution of the electronic-conductivity-imparting agent results in considerable unevenness of electrical resistance, unstable electronic conductivity changing with time, etc.

Furthermore, larger amounts of the electronic-conductivity-imparting agent added result in an increased dependence of electrical resistance to applied voltage, and this has posed a problem that a precise device for controlling applied voltage is necessary for obtaining a constant electrical resistance and a problem that the resultant rubber compositions have impaired processability. It has hence been proposed to add an ionic-conductivity-imparting agent to an ion-conductive polymer or rubber to thereby regulate the volume resistivity of the rubber or polymer to a value in a given range.

Moreover, an intermediate transfer medium having a sea-island structure comprising an ion-conductive polymer as a discontinuous phase and a polymer with reduced moisture permeability as a continuous phase has been proposed as a transfer medium which has reduced unevenness of electrical resistance and in which the electrical resistance is stable under fluctuating environmental conditions (see, for example, patent document 22). However, this intermediate transfer medium has been ineffective in sufficiently improving the transferability of images of superposed toners.

Patent Document 1: JP-A-3-62072
Patent Document 2: JP-A-9-230714
Patent Document 3: JP-A-6-194943
Patent Document 4: JP-A-9-62030
Patent Document 5: JP-A-11-218957
Patent Document 6: JP-A-2002-131973
Patent Document 7: JP-A-8-248779
Patent Document 8: JP-A-2000-206755
Patent Document 9: JP-A-2002-31933
Patent Document 10: JP-A-2002-116599
Patent Document 11: JP-A-2001-092208
Patent Document 12: JP-A-2002-174934
Patent Document 13: JP-A-5-53482
Patent Document 14: JP-A-8-146652
Patent Document 15: JP-A-11-249452
Patent Document 16: JP-A-2000-075541
Patent Document 17: JP-A-10-207164
Patent Document 18: JP-A-5-27548
Patent Document 19: JP-A-2002-278159
Patent Document 20: JP-A-9-152791
Patent Document 21: JP-A-2002-49190
Patent Document 22: JP-A-11-181311

SUMMARY OF THE INVENTION

A first object of the invention is to provide a cleaner-less image-forming apparatus which is an image-forming apparatus wherein images formed by developing electrostatic latent images with toners of different colors are transferred to an intermediate transfer medium and then to a recording medium, specifically an apparatus for color image formation wherein development and transfer are successively conducted to form color toner images on an intermediate transfer medium and the toner images are transferred en bloc to a recording medium such as paper and then fixed, and which has the following advantages. The amount of each toner which remains untransferred on the photoreceptor and should be recovered in the development part by cleaning simultaneously with development can be small. The negatively charged toners on the intermediate transfer medium are prevented from being positively charged, and the toner color mixing caused by reverse toner transfer is thus prevented to thereby attain high color reproducibility.

A second object of the invention is to provide an image-forming apparatus in which toner images formed with toners of different colors on one or more photoreceptors are successively superposed on an intermediate transfer medium with application of a transfer voltage to form color images and these color images are then transferred en bloc to a receiving material, e.g., paper or a synthetic resin film, and fixed thereto to form a color image, and which has the following advantages. The efficiency of transfer is high and, hence, the amount of toner residues remaining untransferred on the photoreceptors is small. As a result, toner consumption is reduced and the amount of waste toners to be recovered is also reduced. Consequently, a prolonged cleaning-member life and a reduced running cost can be attained and a size reduction in waste toner tanks can also be attained.

Other objects and effects of the present invention will become apparent from the following description.

The above-described objects of the present invention have been achieved as described below.

(1) The first object of the invention can be accomplished with an image-forming apparatus in which electrostatic latent images are formed on one or more latent image holding members and are successively developed by developing devices for respective colors to form toner images and then transferred to an intermediate transfer medium, wherein the intermediate transfer medium has a work function smaller than or equal to the work function of each toner (This aspect of the present invention will be hereinafter referred to as "First Invention").

The first invention further provides an image-forming apparatus as described above which is a cleaner-less apparatus in which toner residues remaining untransferred on the latent image holding members are recovered in a development part.

The image-forming apparatus may be one in which the intermediate transfer medium comprises a belt-form member.

The work function of each toner to be used for development ($\Phi t$) and that of the intermediate transfer medium ($\Phi TM$) are thus regulated so as to satisfy the relationship: $\Phi t \geqq \Phi TM$. Due to this constitution, the negatively charged toners transferred to the intermediate transfer medium are prevented from being positively charged and the toner color mixing caused by reverse toner transfer is prevented.

Furthermore, since transfer efficiency can be increased and positive toner charging can be always prevented simultaneously, each toner present on the intermediate transfer medium is not reversely transferred to the photoreceptor to be used for a next development step. Consequently, the toners can be reused and an image-forming apparatus having no cleaner can be provided.

The first invention still further provides an image-forming apparatus as described above wherein the peripheral speed ratio of the latent image holding member and the intermediate transfer medium is from 0.95 to 1.05.

By regulating the difference in peripheral speed between the developing members to a given value for obtaining an attached-toner amount necessary for development on each latent image holding member, high transfer characteristics are obtained due to even electrification of the toners and to the electron (charge) movement caused by the difference in work function. As a result, high-quality color toner images free from color shifting and toner scattering are obtained.

The first invention furthermore provides an image-forming apparatus as described above wherein the toners are negative electrification type toners and the developing devices are devices for reversal development.

The first invention furthermore provides an image-forming apparatus as described above wherein the toners each are a nonmagnetic one-component toner and deposited for development on the latent image holding member in an amount regulated to 0.5 mg/cm$^2$ or smaller.

When each toner is regulated so as to form a thin layer and to be transferred for development in an amount of 0.5 mg/m$^2$ or smaller, then the toner on the developing member can be regulated so as to form nearly a single layer. As a result, the toner surface can be evenly charged negatively. When a toner is superposed on a toner of another color, electron (charge) transfer occurs based on a difference in work function between the toners to equalize the toner layers in electrification. Thus, even color superposition becomes possible.

The first invention furthermore provides an image-forming apparatus as described above wherein a constant-voltage power source is used as a first-transfer power source for the transfer from each latent image holding member to the intermediate transfer medium, and a constant-current power source is used as a second-transfer power source for the transfer from the intermediate transfer medium to the recording medium.

Since the toner layers in the first invention have evenness in electrification, a constant-voltage power source can be used as a power source for the first-transfer part. As a result, stable transfer is possible.

Furthermore, by regulating the amount of toners deposited on the latent image holding member for development to 0.55 mg/cm$^2$ or smaller, the first-transfer voltage to be applied to the transfer medium can be reduced. As a result, nonimage areas can be inhibited from suffering electric discharge during the first transfer between the intermediate transfer medium and each latent image holding member. Consequently, the toner images being transferred can be prevented from scattering toner particles.

This effect eliminates the necessity of successively elevating the first-transfer voltage when the toners are deposited in descending order of work function. Thus, high-quality color toner images can be obtained inevitably.

For obtaining a necessary amount of each toner deposited for development on the latent image holding member, the developing member is made to have a higher peripheral speed so as to result in a peripheral-speed ratio of at least 1.1. The upper limit of the peripheral speed is the highest speed at which toner scattering does not occur. By thus regulating the developing members, each toner layer can be evenly charged and, hence, high transfer characteristics and high-quality color toner images free from color shifting and toner scattering can be obtained.

The increase in the transfer efficiency of each toner results in a remarkable diminution in the amount of the toner remaining untransferred on the latent image holding member. Since the amount of each toner remaining untransferred on the photoreceptor is considerably small, it becomes easy to conduct cleaning simultaneously with development.

Moreover, since each toner to be recovered in the development part can be prevented from mixing with any toner of a different color, image quality with excellent color reproducibility can be maintained over long. Since there is no need of separately disposing a part for storing waste toners resulting from cleaning, the image-forming apparatus can have a reduced size.

In addition, since the amount of each toner recovered is exceedingly small, a mixture thereof with a fresh toner retains stable electrification characteristics. Consequently, printed images and image quality are less apt to deteriorate over long.

(2) The second object of the invention can be accomplished with an image-forming apparatus in which electrostatic latent images are formed on one or more latent image holding members and toner images are formed therefrom using developing devices having toners of different colors and then successively transferred to an intermediate transfer medium with the aid of a transfer voltage supplied from a constant-voltage power source, wherein the intermediate transfer medium contains an ion-conductive substance and has a work function smaller than the work function of each of the toners of different colors.

Since the intermediate transfer medium employed is ion-conductive, the intermediate transfer medium shows stable properties. In addition, the intermediate transfer medium employed has a work function smaller than the work functions of the toners. Consequently, in the first-transfer part where toner images are transferred from the latent image holding members to the intermediate transfer medium, the negatively charged toners transferred from the photoreceptors are less changed from negative to positive. As a result, the amount of reversely transferred toners can be reduced and, hence, an increase in transfer efficiency and a reduction in the amount of waste toners remaining untransferred can be attained.

The second invention further provides an image-forming apparatus as described above wherein the developing devices for respective colors have been disposed so that the toner in the developing device to be used first for development has the largest work function among all toners and the other toners are used in descending order of work function.

The second invention still further provides an image-forming apparatus as described above wherein the toner to be used for developing the electrostatic latent image for a first color has a work function of 5.6 eV or lager.

The second invention furthermore provides an image-forming apparatus as described above wherein the ion-conductive intermediate transfer medium is a belt and the toner images transferred to the intermediate transfer medium are transferred to paper.

The second invention furthermore provides an image-forming apparatus as described above wherein the peripheral speed ratio of the latent image holding member and the intermediate transfer medium is from 0.95 to 1.05.

The second invention furthermore provides an image-forming apparatus as described above wherein the toners each are nonmagnetic one-component toner.

The second invention furthermore provides an image-forming apparatus as described above wherein the amount of each toner conveyed by the developing device is 0.5 mg/cm$^2$ or smaller.

The second invention furthermore provides an image-forming apparatus as described above wherein the amount of the toners deposited for development on the latent image holding member is 0.55 mg/cm$^2$ or smaller.

By thus regulating the amount of the toners deposited for development on the latent image holding member to 0.55 mg/cm$^2$ or smaller, the first-transfer voltage to be applied to the intermediate transfer medium can be lowered. As a result, nonimage areas can be inhibited from suffering electric discharge during the first transfer between the intermediate transfer medium and each latent image holding member. Consequently, toner images being transferred can be prevented from scattering toner particles. This effect can be enhanced by depositing the toners in descending order of work function because an even lower first-transfer voltage can be used in this transfer. Thus, high-quality color toner images can be obtained.

The second invention furthermore provides an image-forming apparatus as described above wherein each developing device is operated at a higher peripheral speed than the latent image holding member, the peripheral-speed ratio between these being from 1.1 to 2.5, and the direction of rotation of the latent image holding member is the same as that of the developing device.

For obtaining a necessary amount of each toner deposited for development on the latent image holding member, the developing member is made to have a peripheral speed increased to such a degree that the peripheral-speed ratio is at least 1.1 and toner scattering does not occur. Thus, high transfer characteristics are obtained due to even electrification of the toners and to the electron (charge) movement caused by the difference in work function. As a result, high-quality color toner images free from color shifting and toner scattering are obtained.

The second invention furthermore provides an image-forming apparatus as described above wherein each toner has a roundness of 0.94 or higher, the roundness being represented by the ratio $L_0/L_1$, wherein $L_1$ is the length (μm) of the periphery of a projected image of each toner particle and $L_0$ is the length (μm) of the periphery of the complete circle equal in area to the projected image of the toner particle.

The second invention furthermore provides an image-forming apparatus as described above wherein each toner has a number-average particle diameter of from 4.5 to 9 μm.

The second invention furthermore provides an image-forming apparatus as described above wherein a constant-voltage power source is used as a first-transfer power source for the transfer from each latent image holding member to the intermediate transfer medium, and a constant-current power source is used as a second-transfer power source for the transfer from the intermediate transfer medium to the recording medium.

The second invention furthermore provides an image-forming apparatus as described above wherein each of the developing devices for respective colors has been united with the corresponding latent image holding member to constitute a process cartridge, and the process cartridge has been removably mounted in the image-forming apparatus.

The second invention furthermore provides toners for use in an image-forming apparatus in which electrostatic latent images are formed on one or more latent image holding members and toner images are formed therefrom using developing devices for respective colors and then successively transferred to an intermediate transfer medium containing an ion-conductive substance with the aid of a transfer voltage supplied from a constant-voltage power source, the toners of different colors each having a work function larger than the work function of the intermediate transfer medium and containing hydrophobic silica and hydrophobic titanium oxide as fluidizing agents.

Figure 1A:
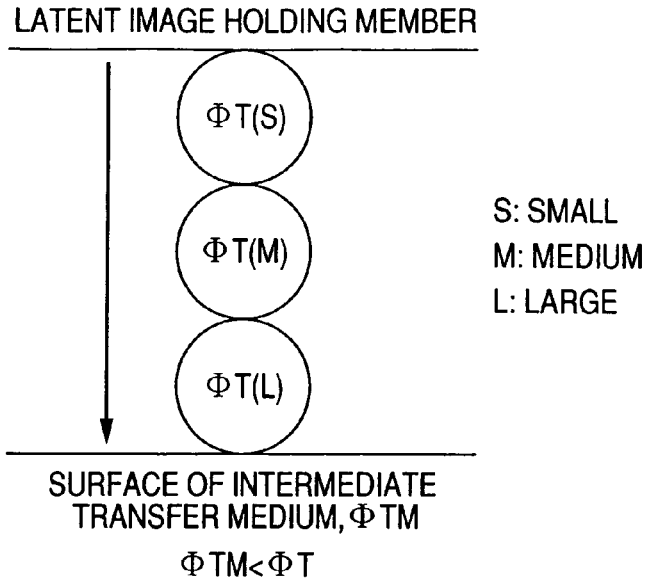
FIGS. 1A–1C are views illustrating the charged states of toners on an intermediate transfer medium.

The reference numerals used in the drawings represent the followings, respectively.

1: photoreceptor, 2: corona charging device, 3: exposure, 4: intermediate transfer medium, 5: cleaning blade, 6: back-up roller, 7: toner feed roller, 8: regulation blade, 9: development roller, 10: developing device, 10(Y), 10(M), 10(C), 10(K): developing device, T: toner, 11: driving roller, 12: driven roller, 30: intermediate transfer device, 40: exposure unit, L1: exposure, 50: paper feeder, 100: image holding member cartridge, 140: photoreceptor, 160: charging roller, 170: cleaning device, 201: image-forming apparatus, 202: housing, 203: discharged-paper tray, 204: door, 205: control unit, 206: power unit, 207: exposure unit, 208: image-forming unit, 209: exhaust fan, 210: transfer unit, 211: paper feed unit, 212: paper-conveying unit, 213: driving roller, 214: driven roller, 215: intermediate transfer belt, 216: cleaning-device, 217: belt stretching side, 218: belt loosening side, 219: second-transfer roller, 220: image holding member, 221: first-transfer member, 222: charging device, 223: developing device, 224: polygon mirror motor, 225: polygon mirror, 226: f-θ lens, 227: reflecting mirror, 228: return mirror, 229: toner container, 230: toner storage part, 231: toner stirrer, 232: partitioning member, 233: toner feed roller, 234: charging blade, 235: development roller, 236: regulation blade, 238: paper cassette, 239: pickup roller, 240: pair of gate rollers, 241: main recording medium conveyance passage, 242: fixing device, 243: pair of paper discharge rollers, 244: conveyance passage for double-side printing, 245: pair of fixing rollers, C1: sample examination cell, C2: recess for toner placement, C3: sample piece to be examined, C4: sample table, C5: light for measurement, C6: photoelectron, and C7: detector.

DETAILED DESCRIPTION OF THE INVENTION

The present invention will be described in more detail below.

Work Function of Toner and Intermediate Transfer Medium

The work functions of the toners and intermediate transfer medium in the invention are explained below.

The work function (Φ) of a substance is known as the energy necessary for taking electrons out of the substance. The smaller the work function, the more the substance is apt to release electrons. The larger the work function, the less the substance releases electrons. Because of this, when a substance having a small work function is brought into contact with a substance having a large work function, then the substance having a small work function is positively charged and the substance having a large work function is negatively charged.

Work function can be determined by the following measuring method. The value of work function shows the energy (eV) necessary for taking electrons out of the substance. It can be used as an index based on which a toner, which consists of various substances, can be evaluated for the property of being electrified by contact with various members of an image-forming apparatus.

Work function (Φ) is determined with a surface analyzer (AC-2, manufactured by Riken Keiki Co., Ltd.; low-energy-electron counting type). In the invention, the surface analyzer equipped with a deuterium lamp is used. The quantity of irradiation light is set at 500 nW. A monochromatic ray is selected with a spectrograph. A sample is irradiated with the ray under the conditions of an irradiation area of 4 mm square, energy scanning range of from 3.4 to 6.2 eV, and examination period of 10 seconds per site. Photoelectrons released from the sample surface are detected to determine the work function. Measurements for work function determination are made with a repeatability (standard deviation) of 0.02 eV. For securing data reproducibility, measurements were made in an atmosphere having a temperature of 25° C. and a humidity of 55% RH. The samples to be examined were allowed to stand in the atmosphere for 24 hours.

Image-Forming Apparatus of the First Invention

The first invention is based on the following finding concerning an image-forming apparatus in which electrostatic latent images on latent image holding members are successively developed with toners of different colors and the resultant toner images are transferred to an intermediate transfer medium. When the intermediate transfer medium is regulated so as to have a work function smaller than or equal to the work function of each of the toners of different colors, then each toner transferred to the intermediate transfer medium is prevented from being reversely charged to becomes a positive toner and being thus reversely transferred to the photoreceptor to be used for image formation in the next color. Because of this, even when the toner residues remaining untransferred are recovered and reused, toner color mixing can be prevented. Consequently, an image-forming apparatus having no cleaner can be provided.

FIGS. 1 are views illustrating the charged states of toners on an intermediate transfer medium. These views show that negatively charged toners do not change into positively charged toners.

FIG. 1(A) shows the case in which toners of different colors are used as a composite toner for the development and transfer of a solid image. The figure shows toners arranged in a row.

Toners are deposited for development and transferred in descending order of work function. The toners are electrostatically attached to the intermediate transfer belt, the surface of which has a work function smaller than the work function of each toner. Electrons (charges) move in the direction indicated by the arrow and the uppermost toner comes to have a reduced charge amount. The toners are hence prevented from being separated by a repulsive force and are in a satisfactorily superposed state. Furthermore, when the transfer is constant-voltage transfer, the direction of the flow of electrons (charges) is the same as the direction of transfer. This is thought to bring about an increased transfer efficiency. Simultaneously with the transfer, electrons (charges) move from the intermediate transfer belt to the toner constituting the lowermost layer to negatively charge the toner. Although the toner can come to have a larger amount of negative charges, it never becomes positive. The occurrence of reverse toner transfer is thought to be thus prevented.

Figure 1B:
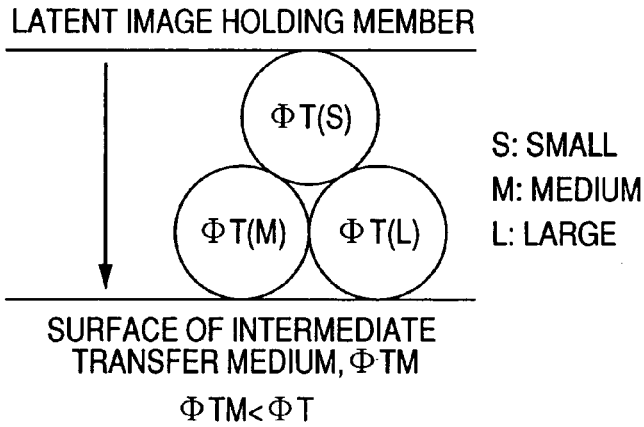

FIG. 1(B) shows the case in which a half-tone image is developed and transferred. In this case, the toners are arranged adjacently. The toners have been deposited for development and transferred in descending order of work function, and are electrostatically attached to the intermediate transfer belt.

Electrons (charges) move in the direction indicated by the arrow and the uppermost toner comes to have a reduced charge amount. The toners are hence prevented from being separated by a repulsive force and are in a satisfactorily superposed state. Furthermore, when the transfer is constant-voltage transfer, the direction of the flow of charges is the same as the direction of transfer. This is thought to bring about an increased transfer efficiency. Simultaneously with the transfer, electrons (charges) move from the intermediate transfer belt to the toner constituting the lowermost layer to negatively charge the toner. Although the toner can come to have a larger amount of negative charges, it never becomes positive. The occurrence of reverse toner transfer is thought to be thus prevented.

Figure 1C:
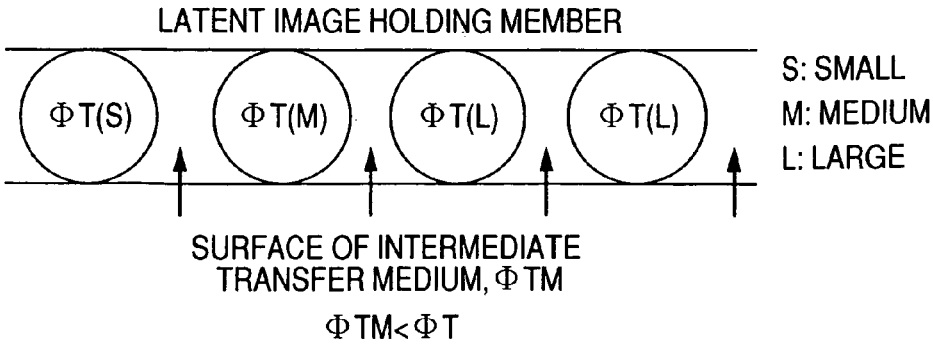

FIG. 1(C) shows the case in which monochroic line images are developed and transferred. Toners are electrostatically attached to the intermediate transfer belt. Electrons (charges) move from the intermediate transfer belt to the toners to negatively charge the toners. Although the toners can come to have a larger amount of negative charges, they never become positive. The occurrence of reverse toner transfer is thought to be thus prevented.

Figure 2:
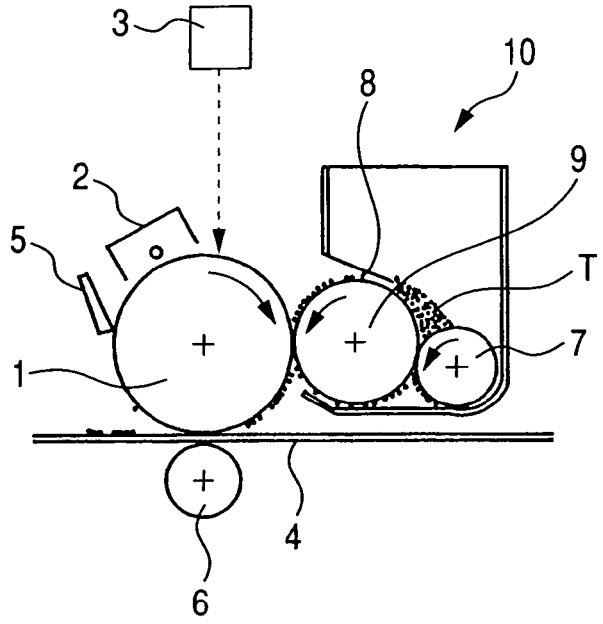
FIG. 2 is a view illustrating an image-forming apparatus according to the invention.

FIG. 2 is a view illustrating an image-forming apparatus according to the first invention.

FIG. 2 shows one embodiment of the image-forming apparatus of the invention of the contact development type. It employs a photoreceptor 1 which is a photoreceptor drum having a diameter of from 24 to 86 mm and rotating at a peripheral speed of from 60 to 300 mm/s. The surface of the photoreceptor 1 is negatively charged evenly with a corona charging device 2 and then subjected to exposure 3 according to information to be recorded. Thus, an electrostatic latent image is formed.

A developing device 10, which is a developing device for development with a one-component toner, supplies a one-component nonmagnetic toner T to the organic photoreceptor, whereby the electrostatic latent image on the organic photoreceptor is made visible by reversal development. The developing device contains the one-component nonmagnetic toner T. As shown in the figure, the toner is supplied to a development roller 9 with a toner feed roller 7 rotating counter-clockwise. The development roller 9 rotates counter-clockwise and conveys the toner T, supplied with the toner feed roller 7, to the part for contact with the organic photoreceptor while holding the toner T on the surface thereof. The electrostatic latent image on the organic photoreceptor 1 is thus made visible.

The development roller 9 has a diameter of, for example, from 16 to 24 mm. It may be a roller obtained by subjecting a metallic pipe to plating or blasting, or may be one comprising a core and, formed on the periphery thereof, a conductive elastomer layer made of a butadiene rubber, styrene/butadiene rubber, ethylene/propylene rubber, urethane rubber, silicone rubber, or the like and having a volume resistivity of from $10^4$ to $10^8$ Ω·cm and a hardness of from 40 to 70° (Asker A hardness). A development bias voltage is applied through, e.g., the pipe core from a power source not shown. The developing device 10, which includes the development roller 9, the toner feed roller 7, and a toner regulation blade 8, is preferably pressed against the organic photoreceptor with an energizing device not shown, e.g., a spring, at a pressure of from 19.6 to 98.1 N/m, preferably from 24.5 to 68.6 N/m, so as to result in a nip width of from 1 to 3 mm.

As the regulation blade 8 may be used, for example, a stainless-steel, phosphor bronze, or rubber plate or a blade comprising a metal sheet and a rubber chip bonded thereto. It is preferred that the regulation blade 8 be pressed against the development roller with an energizing device not shown, e.g., a spring, or by means of the resilience of the elastomer at a linear pressure of from 245 to 490 mN/cm so as to make the toner on the development roller form about one or two layers.

In contact development, the photoreceptor is preferably regulated so as to have a dark potential of from −500 to −700 V and a light potential of from −50 to −150 V, and the development bias voltage not shown is preferably from −100 to −400 V. The development roller is preferably regulated so as to have the same potential as the toner feed roller.

In the contact development, the peripheral speed of the development roller, which rotates counter-clockwise, is desirably regulated to from 1.1 to 2.5 times, preferably from 1.2 to 2.2 times, the peripheral speed of the organic photoreceptor, which rotates clockwise. By thus regulating the peripheral speed of the development roller, even toner particles having a small particle diameter can be charged by contact friction with the organic photoreceptor without fail.

There are no particular limitations on the relationship between the work function of each of the regulation blade and the development roller and the work function of the toner. Preferably, however, the regulation blade and the development roller each have a work function smaller than the work function of the toner so as to negatively charge the toner by contact with the regulation blade. Thus, the toner can be negatively charged more evenly. A voltage may be applied to the regulation blade 8 to inject charges into the toner in contact with the blade and thereby control the amount of charges on the toner.

The intermediate transfer medium in the image-forming apparatus of the first invention is explained next. As shown in FIG. 2, an intermediate transfer medium 4 is caused to run between the photoreceptor 1 and a back-up roller 6. A voltage is applied to the intermediate transfer medium 4, whereby the visible image on the photoreceptor 1 is transferred to the intermediate transfer medium. Thus, a toner image is formed on the intermediate transfer medium. The toner remaining on the photoreceptor is removed with a cleaning blade 5, and the electrostatic charges on the photoreceptor are erased with an erase lamp. The photoreceptor is then subjected to use again. Since the toner in the image-forming apparatus of the first invention can be inhibited from being reversely charged, the amount of the toner remaining on the photoreceptor can be reduced and the vessel for storing the toner recovered by cleaning can be made smaller.

In the case where the intermediate transfer medium is a transfer drum or transfer belt, a voltage of from +250 to +600 V is preferably applied as a first-transfer voltage to the conductive layer of the transfer medium. For second transfer, which is transfer to a receiving material such as paper, a voltage of from +400 to +2,800 V is preferably applied as a second-transfer voltage.

As the intermediate transfer medium can be used a transfer belt or transfer drum. The transfer belt may be one comprising a film or sheet base made of a synthetic resin and a transfer layer formed thereon or one comprising a base layer made of an elastic material and a transfer layer formed thereon as a surface layer. In the case where the photoreceptor is one comprising a rigid drum, e.g., an aluminum drum, and an organic photosensitive layer formed thereon, the transfer drum may be one comprising a rigid drum base made of, e.g., aluminum and an elastic transfer layer formed thereon as a surface layer. Furthermore, when the substrate of the photoreceptor is in a belt form or when the photoreceptor is a so-called elastic photoreceptor comprising an elastic substrate made of, e.g., a rubber and a photosensitive layer formed thereon, then a preferred transfer medium comprises a rigid drum base made of, e.g., aluminum and a transfer layer formed thereover directly or through a conductive interlayer.

As the base can be used a conductive or insulating base. In the case of a transfer belt, the volume resistivity thereof is preferably in the range of from $10^4$ to $10^{12}$ Ω·cm, more preferably from $10^6$ to $10^{11}$ Ω·cm.

Materials suitable for the film or sheet and a preferred production process are as follows. A conductive material such as, e.g., a conductive carbon black, conductive titanium oxide, conductive tin oxide, or conductive silica is dispersed in an engineering plastic such as, e.g., a modified polyimide, thermosetting polyimide, polycarbonate, ethylene/tetrafluoroethylene copolymer, poly(vinylidene fluoride), or nylon alloy. The resultant composition is extruded or molded into a seamless semiconductive film base having a thickness of from 50 to 500 μm. The outer surface of this base is coated with a fluororesin in a thickness of from 5 to 50 μm as a surface protective layer for further reducing the surface energy and preventing toner filming. Thus, a seamless belt for use as a transfer belt is produced.

For forming the surface protective layer, use can be made of dip coating, ring coating, spray coating, or the like. A tape such as, e.g., a poly(ethylene terephthalate) film having a thickness of 80 μm or a rib made of, e.g., a urethane rubber is applied to each edge of the transfer belt before use in order to prevent the transfer belt from cracking or elongating at the edges or from coming to run meanderingly.

In the case where a film or sheet is used to produce a base, a belt can be produced by conducting end jointing by ultrasonic welding. Specifically, a transfer belt having desired properties can be produced by forming a conductive layer and a surface layer on a film or sheet and then conducting ultrasonic welding. More specifically, in the case where poly(ethylene terephthalate) having a thickness of from 60 to 150 μm is used as an insulating base, aluminum or the like is vapor-deposited on a surface thereof and an intermediate conductive layer made of a conductive material, e.g., carbon black, and a resin is optionally further formed thereon by coating. Thereon is further formed a semiconductive surface layer having higher surface resistance than the underlying layer and comprising a urethane resin, fluororesin, and conductive material. Thus, a transfer belt can be produced. In the case where a resistive layer which does not need much heat for drying after application can be formed, use can be made of a method in which a film coated with vapor-deposited aluminum is first subjected to ultrasonic welding and the resistive layer is formed thereafter to produce a transfer belt.

Materials suitable for the elastic base made of a rubber or the like and a preferred production process are as follows. Any of the conductive materials shown above is dispersed in a silicone rubber, urethane rubber, nitrile rubber, ethylene/propylene rubber, or the like and the resultant composition is extrusion-molded to produce a semiconductive rubber belt having a thickness of from 0.8 to 2.0 mm. Thereafter, the surface of the belt is treated with an abrasive material such as a sandpaper or polisher to regulate the surface roughness to a desired value. Although the elastic layer thus obtained may be used as it is, a surface layer can be further formed thereon in the same manner as described above.

In the case of a transfer drum, the volume resistivity thereof is preferably in the range of from $10^4$ to $10^{12}$ Ω·cm, more preferably from $10^7$ to $10^{11}$ Ω·cm. A transfer drum can be produced from a cylinder made of a metal, e.g., aluminum, by optionally forming a conductive interlayer of an elastomer to obtain a conductive elastic base and further forming thereon a semiconductive coating made of, e.g., a fluororesin and having a thickness of from 5 to 50 μm as a surface protective layer for reducing the surface energy and preventing toner filming.

The conducive elastic base is preferably formed by adding a conductive material such as a carbon black, conductive titanium oxide, conductive tin oxide, or conductive silica to a rubber material such as, e.g., a silicone rubber, urethane rubber, nitrile rubber (NBR), ethylene/propylene rubber (EPDM), butadiene rubber, styrene/butadiene rubber, isoprene rubber, chloroprene rubber, butyl rubber, epichlorohydrin rubber, or fluororubber, kneading this mixture to disperse the conductive material, applying the resultant conductive rubber material tightly on an aluminum cylinder having a diameter of from 90 to 180 mm, and then polishing the conductive rubber material applied to thereby form a conductive rubber layer having a thickness of from 0.8 to 6 mm and a volume resistivity of from $10^4$ to $10^{10}$ Ω·cm. Subsequently, a semiconductive surface layer comprising a urethane resin, fluororesin, conductive material, and fine fluororesin particles is formed in a thickness of about from 15 to 40 μm. Thus, a transfer drum having the desired volume resistivity of from $10^7$ to $10^{11}$ Ω·cm can be produced. The surface roughness of this transfer drum is preferably 1 μm (Ra) or less. In another usable method, a semiconductive tube made of, e.g., a fluororesin is put on a conductive elastic base produced in the manner described above and is then thermally shrunk to thereby produce a transfer drum having a desired surface layer and the desired electrical resistance.

Figure 3:
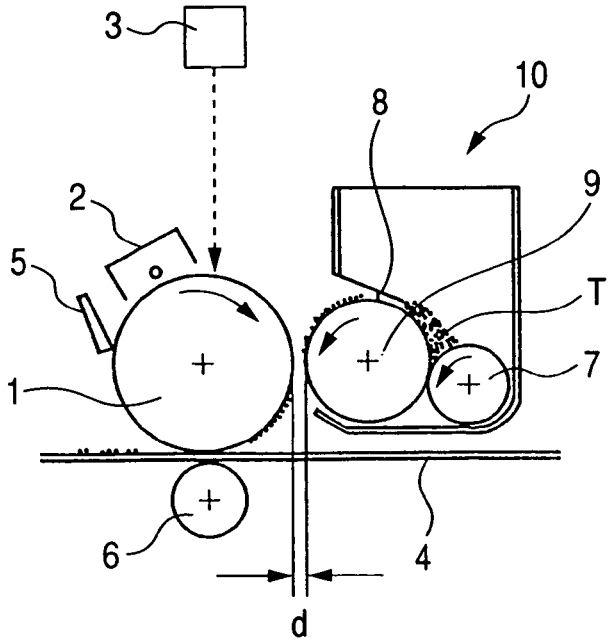
FIG. 3 is a view illustrating another image-forming apparatus according to the invention.

FIG. 3 shows one embodiment of the image-forming apparatus of the first invention of the non-contact development type. In this type, a development roller 9 and a photoreceptor 1 are disposed face-to-face so as to form a development gap d therebetween. The development gas is preferably from 100 to 350 μm. This apparatus is preferably operated under such conditions that a direct-current development bias, which is not shown, of from −200 to −500 V is used and an alternating-current voltage having a frequency of from 1.5 to 3.5 kHz and a P—P voltage of from 1,000 to 1,800 V is superimposed thereon. In this non-contact development type, the peripheral speed of the development roller, which rotates counter-clockwise, is desirably regulated to from 1.1 to 2.5 times, preferably from 1.2 to 2.2 times, the peripheral speed of the organic photoreceptor, which rotates clockwise.

As shown in the figure, the development roller 9 rotates counter-clockwise and conveys a toner T, supplied with a toner feed roller 7, to its part facing the organic photoreceptor while holding the toner T adsorbed on the surface thereof. An alternating-current voltage is superimposed and applied to the part where the organic photoreceptor faces the development roller, upon which application the toner T vibrates between the development roller surface and the surface of the organic photoreceptor to conduct development. In the invention, the toner T vibrates between the development roller surface and the organic-photoreceptor surface upon application of an alternating-current voltage and, during this vibration, the toner particles are charged by contact with one another. It is thought that positively charged toner particles having a small particle diameter can be negatively charged and fog can be thus diminished.

An intermediate transfer medium is caused to run between the photoreceptor 1 bearing a visible image and a back-up roller 6. The back-up roller 6 is desirably pressed against the photoreceptor 1 at a pressure of from 18 to 45 N/m, preferably from 26 to 38 N/m.

Thus, toner particles can be brought into contact with the photoreceptor without fail, and the negative electrification of the toner particles can be enhanced to thereby attain an improved transfer efficiency.

In this non-contact development type apparatus, matters other than those shown above are the same as in the contact development type apparatus described above.

When the development process shown in FIG. 2 or FIG. 3 is practiced on a combination of developing devices employing toners (developers) of four colors consisting of yellow Y, cyan C, magenta M, and black B with one or more photoreceptors, then an apparatus capable of forming a full-color image can be constituted.

Figure 4:
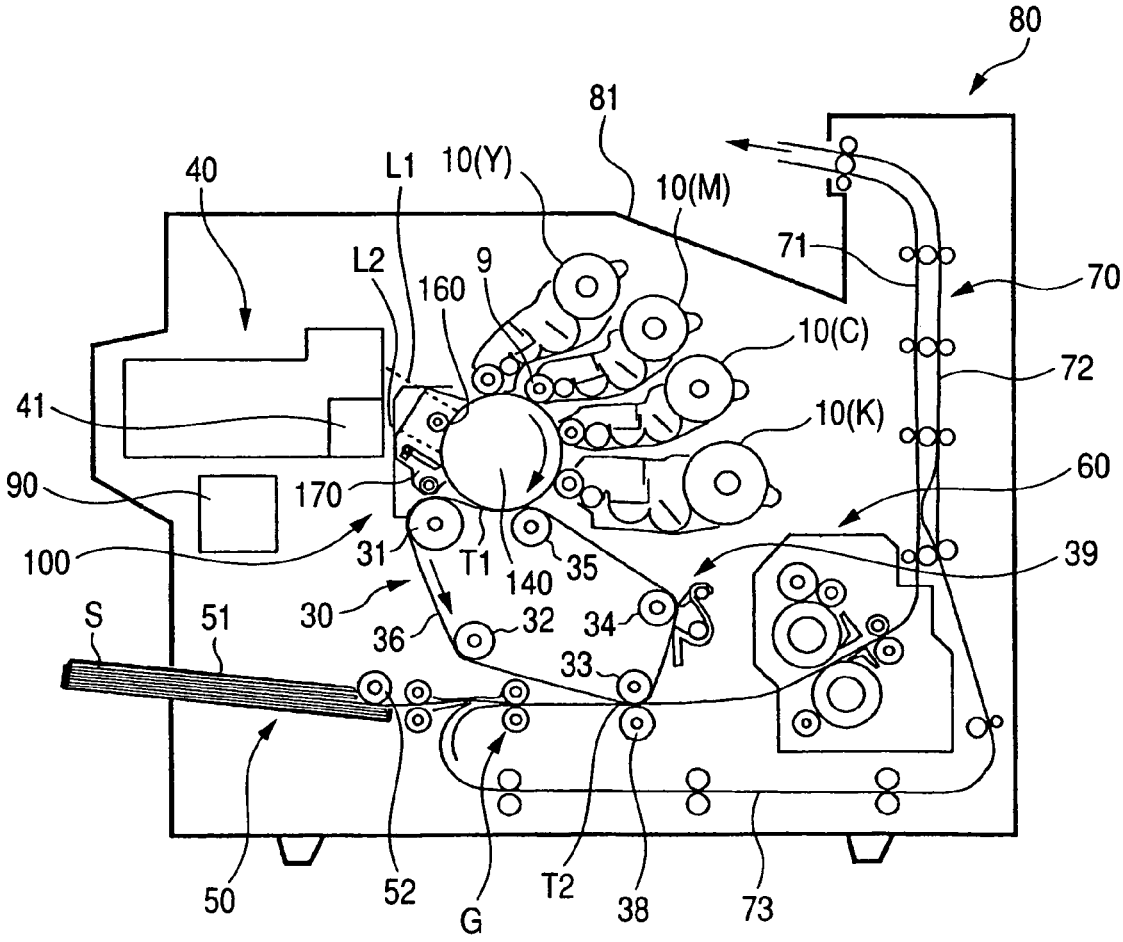
FIG. 4 is a view illustrating one embodiment of a four-cycle full-color printer according to the invention.

Next, an explanation is given below on an image-forming apparatus according to the first invention to which negative electrification type dry toners are applied. FIG. 4 is a view illustrating one embodiment of a four-cycle full-color printer.

In FIG. 4, numeral 100 denotes an image holding member cartridge into which an image holding member unit has been incorporated. In this embodiment, a photoreceptor has been fabricated as a photoreceptor cartridge so as to be mounted separately from a development part unit. The electrophotographic photoreceptor (latent image holding member) 140 is rotated in the direction indicated by the arrow by means of an appropriate driving unit not shown. Around the photoreceptor 140 are disposed, along the direction of rotation thereof, a charging roller 160 as a charging device, developing devices 10 (Y, M, C, and K) as developing units, an intermediate transfer device 30, and a cleaning device 170.

It should be noted that the image-forming apparatus of the first invention does not necessitate the cleaning device 170. However, the embodiment having a cleaning device is explained for the purpose of explaining the Examples and Comparative Examples which will be given below.

The charging roller 160 is in contact with the peripheral surface of the photoreceptor 140 to evenly charge the peripheral surface. The evenly charged peripheral surface of the photoreceptor 140 is subjected to selective exposure L1 with an exposure unit 40 according to desired image information. As a result of this exposure L1, an electrostatic latent image is formed on the photoreceptor 140. This electrostatic latent image is developed with a developer by a developing device 10.

As developing devices have been disposed a developing device 10Y for yellow, developing device 10M for magenta, developing device 10C for cyan, and developing device 10K for black. These developing devices 10Y, 10C, 10M, and 10K each have been swingablly constituted so that the development roller 9 of one developing device only is selectively pressed against the photoreceptor 140. These developing devices 10 each hold a negatively charged toner on the development roller, and these developing devices 10 supply any one of toners of yellow Y, magenta M, cyan C, and black K to the surface of the photoreceptor 140 to develop the electrostatic latent image on the photoreceptor 140. The development rollers 9 each are constituted of a rigid roller, e.g., a metal roller having a roughened surface. The toner image developed is transferred to an intermediate transfer belt 36 of the intermediate transfer device 30. The cleaning device 170 comprises: a cleaner blade for scraping off the toner T attached to the peripheral surface of the photoreceptor 140 after the transfer; and a recovered-toner container for receiving the toner scraped off by the cleaner blade.

The intermediate transfer device 30 comprises a driving roller 31, four driven rollers 32, 33, 34, and 35, and an endless intermediate transfer belt 36 stretched around these rollers. The driving roller 31 has a gear not shown which has been fixed to an end thereof. This gear is engaged with a gear for driving the photoreceptor 140 so that the driving roller 31 is rotated at almost the same peripheral speed as the photoreceptor 140. Consequently, the intermediate transfer belt 36 is circulated in the direction indicated by the arrow at almost the same peripheral speed as the photoreceptor 140.

The driven roller 35 is disposed in such a position that the intermediate transfer belt 36, in its part located between the driven roller 35 and the driving roller 31, is pressed against the photoreceptor 140 by its own tension. Thus, the part at which the intermediate transfer belt 36 is pressed against the photoreceptor 140 constitutes a first-transfer part T1. The driven roller 35 is disposed near the first-transfer part T1 on the upstream side thereof with respect to the circulation of the intermediate transfer belt.

The driving roller 31 has an electrode roller not shown disposed through the intermediate transfer belt 36. A first-transfer voltage is applied through this electrode roller to the conductive layer of the intermediate transfer belt 36. The driven roller 32 is a tension roller and has an energizing device not shown, with which the intermediate transfer belt 36 is pushed in such a direction that the stretching thereof is enhanced. The driven roller 33 is a back-up roller which forms a second-transfer part T2. A second-transfer roller 38 has been disposed so as to face the back-up roller 33 through the intermediate transfer belt 36. A second-transfer voltage is applied to the second-transfer roller, which has been constituted so that the distance from the intermediate transfer belt 36 can be regulated with a gap-regulating mechanism not shown. The driven roller 34 is a back-up roller for a belt cleaner 39. The belt cleaner 39 has been constituted so that the distance from the intermediate transfer belt 36 can be regulated with a gap-regulating mechanism not shown.

The intermediate transfer belt 36 is constituted of a multilayer belt having a conductive layer and formed thereon a resistive layer to be pressed against the photoreceptor 140. The conductive layer has been formed on an insulating base made of a synthetic resin. A first-transfer voltage is applied to this conductive layer through the electrode roller. In edge parts of the belt, the resistive layer has been removed in strip areas to expose the conductive layer in the strip areas. The electrode roller comes into contact with the conductive layer in these exposed areas.

In the course of the circulation of the intermediate transfer belt 36, the toner image on the photoreceptor 140 is transferred to the intermediate transfer belt 36 in the first-transfer part T1, and the toner image transferred to the intermediate transfer belt 36is transferred in the second-transfer part T2 to a recording medium S, e.g., paper, supplied to the nip between the intermediate transfer belt 36 and the second-transfer roller 38. The sheet S is supplied from a paper feeder 50; the sheet S is introduced into the second-transfer part T2 with a given timing by means of a pair of gate rollers G. Numeral 51 denotes a paper cassette and 52 denotes a pickup roller.

The toner image is fixed in a fixing device 60, and the sheet S is passed through a paper discharge passage 70 and discharged onto a sheet-receiving part 81 on a housing 80 of the apparatus main body. This image-forming apparatus has two independent paper discharge passages 71 and 72 as paper discharge passages 70. A sheet which has passed through the fixing device 60 is discharged through one of the paper discharge passages 71 and 72. The paper discharge passages 71 and 72 include a switchback passage so that when an image is to be formed on both sides of a sheet, the sheet which has once entered the paper discharge passage 71 or 72 can be supplied again to the second-transfer part T2 through return rollers 73.

The whole operations of the image-forming apparatus described above are summarized below.

(1) When image information is sent from, e.g., a personal computer not shown to a control unit 90 of the image-forming apparatus, then the photoreceptor 140, the rollers 9 of the respective developing devices 10, and the intermediate transfer belt 36 are rotated or circulated.

(2) The peripheral surface of the photoreceptor 140 is evenly charged by the charging roller 160.

(3) The evenly charged peripheral surface of the photoreceptor 140 is subjected to selective exposure L1 according to image information on a first color (e.g., yellow) with the exposure unit 40 to form an electrostatic latent image for yellow.

(4) The development roller of only the developing device for a first color, e.g., the developing device lOY for yellow, is brought into contact with the photoreceptor 140. The electrostatic latent image is thus developed and a toner image of yellow as the first color is formed on the photoreceptor 140.

(5) A first-transfer voltage having the polarity opposite to the charge polarity of the toner is applied to the intermediate transfer belt 36, and the toner image formed on the photoreceptor 140 is transferred to the intermediate transfer belt 36 in the first-transfer part T1. During this transfer, the second-transfer roller 38 and the belt cleaner 39 are kept apart from the intermediate transfer belt 36.

(6) The toner remaining on the photoreceptor 140 is removed by the cleaning device 170. Thereafter, any residual charges are removed from the photoreceptor 140 with a charge erase light L2 emitted from an eraser 41.

(7) The operations (2) to (6) are repeated according to need. Namely, the operations are repeated for second, third, and fourth colors according to printing command signals, and toner images in accordance with the printing command signals are formed on the intermediate transfer belt 36 so as to be superposed on one another.

(8) A sheet S is supplied from the paper feeder 50 with a given timing. The second-transfer roller 38 is brought into contact with the intermediate transfer belt 36, just before the front end of the sheet S reaches the second-transfer part T2 or after the front end reaches the part T2, i.e., with such a timing that the toner images on the intermediate transfer belt 36 can be transferred to given positions on the sheet S. As a result, the toner images on the intermediate transfer belt 36, i.e., a full-color image formed by the superposed toner images of four colors, are transferred to the sheet S. Furthermore, the belt cleaner 39 is brought into contact with the intermediate transfer belt 36 to remove the toners remaining on the intermediate transfer belt 36 after the second transfer.

(9) The recording medium S passes through the fixing device 60, whereby the toner images on the sheet S are fixed. Thereafter, the sheet S is conveyed toward a given position (toward the sheet-receiving part 81 in the case of one-side printing, or toward the return rollers 73 through the switchback passage 71 or 72 in the case of double-side printing).

In this image-forming apparatus according to the first invention, the development rollers 9 and the intermediate transfer medium 36 may be kept in contact with the photoreceptor 140, or the development may be non-contact development.

Figure 5:
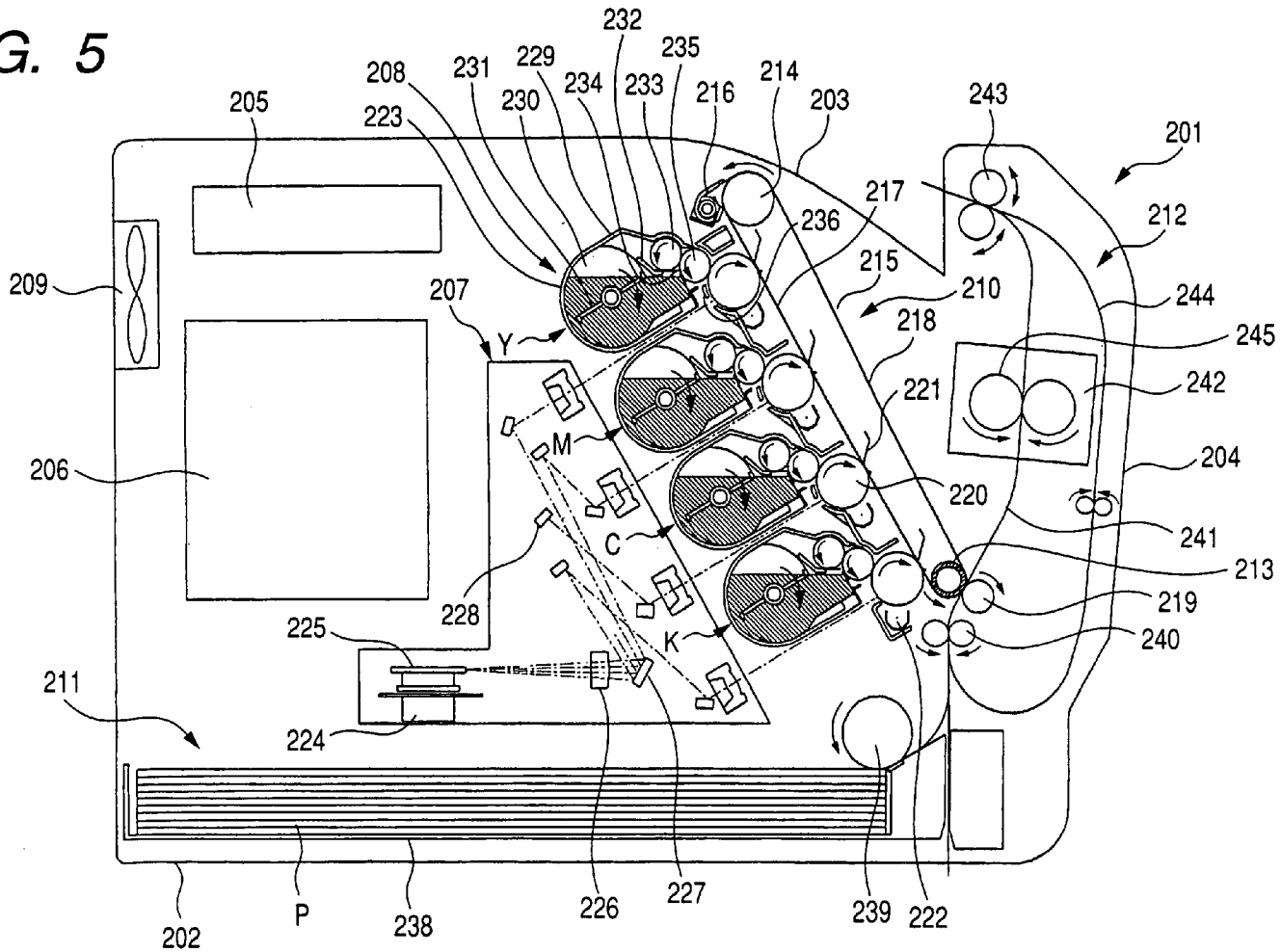
FIG. 5 is a view illustrating one embodiment of a tandem full-color printer according to the first invention.

A diagrammatic front view of a tandem full-color printer according to the first invention is shown in FIG. 5.

In FIG. 5, the image-forming apparatus 201 shown as an embodiment has a housing 202, a discharged-paper tray 203 formed on the housing 202, and a door 204 attached to the front side of the housing 202 in a freely openable/closable manner. Within the housing 202 have been disposed a control unit 205, power unit 206, exposure unit 207, image-forming unit 208, exhaust fan 209, transfer unit 210, and paper feed unit 211. Within the door 204 has been disposed a paper-conveying unit 212. Each unit is removable from the main body. Namely, this apparatus has such a constitution that each unit as a whole can be demounted for repair or replacement in maintenance, etc.

The transfer unit 210 comprises: a driving roller 213 disposed in a lower part of the housing 202 and rotated by a driving source not shown; a driven roller 214 disposed obliquely-over the driving roller 213; an intermediate transfer belt 215 which is stretched with and between these two rollers only and is circulated along the direction indicated by the arrows (counter-clockwise); and a cleaning device 216 which is in contact with the surface of the intermediate transfer belt 215. The driven roller 214 and the intermediate transfer belt 215 have been disposed so as to be inclined to the left of the driving roller 213 in the figure. Thus, the belt stretching side 217 which stretches when the intermediate transfer belt 215 is operated (the side pulled by the driving roller 213) is located below, and the belt loosening side 218 is located above.

The driving roller 213 serves also as a back-up roller for a second-transfer roller 219, which will be described below. The driving roller 213 has, formed on the peripheral surface thereof, a rubber layer having a thickness of about 3 mm and a volume resistivity of $1\times10^5$ Ω·cm or lower. This rubber layer is grounded through a metallic core to thereby constitute a conduction passage for a second-transfer bias supplied through the second-transfer roller 219. By thus forming a highly frictional rubber layer having shock-absorbing properties as a component of the driving roller 213, the shock caused by a recording medium entering a second-transfer part can be made to be less transmitted to the intermediate transfer belt 215. Consequently, image quality deterioration can be prevented.

In this embodiment, the driving roller 213 has a smaller diameter than the driven roller 214. This enables the recording paper after second transfer to easily separate based on the elasticity of the recording paper itself.

The cleaning device 216 has been disposed on the belt stretching side 217.

First-transfer members 221 each comprising a flat-spring electrode are kept in contact with the back side of the intermediate transfer belt 215 by their elasticity so as to face the image holding members 220 of monochroic-image-forming units Y, M, C, and K for respective colors, which constitute the image-forming unit described below. A transfer bias is kept being applied to the first-transfer members 221.

The image-forming unit 208 includes monochroic-image-forming units Y (for yellow), M (for magenta), C (for cyan), and K (for black) for forming images of different colors (four colors in this embodiment). These monochroic-image-forming units Y, M, C, and K each comprises: an image holding member 220 comprising a photoreceptor having an organic photosensitive layer and an inorganic photosensitive layer; a charging device 222 disposed beside the image holding member 220 and comprising a corona charging device or charging roller; and a developing device 223.

The image holding members 220 of the respective monochroic-image-forming units Y, M, C, and K are kept in contact with the belt stretching side 217 of the intermediate transfer belt 215. As a result, the monochroic-image-forming units Y, M, C, and K also are disposed so as to be inclined to the left of the driving roller 213 in the figure. Each image holding member 220 is rotated in the direction indicated by the arrow, which is opposite to that for the intermediate transfer belt 215.

The exposure unit 207 has been disposed obliquely under the image-forming unit 208. This exposure unit has a polygon mirror motor 224, a polygon mirror 225, an f-θ lens 226, a reflecting mirror 227, and return mirrors 228 inside. Image signals for the respective colors are modulated based on common data clock frequencies and emitted from the polygon mirror 225. The image signals emitted pass through the f-θ lens 226, are reflected by the reflecting mirror 227 and return mirrors 228, and strike on the image holding members 220 of the respective monochroic-image-forming units Y, M, C, and K to form latent images. The light paths to the image holding members 220 of the respective monochroic-image-forming units Y, M, C, and K have been regulated with the return mirrors 228 so as to be substantially the same distance.

The developing devices 223 will be explained below using the monochroic-image-forming unit Y as a representative. In this embodiment, since the monochroic-image-forming units Y, M, C, and K have been disposed so as to be inclined to the left in the figure, toner containers 229 have been disposed so as to be inclined downward.

Namely, the developing device 223 is constituted of a toner container 229 for containing a toner therein, a toner storage part 230 (hatched part in the figure) formed in the toner container 229, a toner stirrer 231 disposed in the toner storage part 230, a partitioning member 232 which partitions over the toner storage part 230, a toner feed roller 233 disposed above the partitioning member 232, a charging blade 234 disposed on the partitioning member 232 and kept in contact with the toner feed roller 233, a development roller 235 disposed close to the toner feed roller 233 and the image holding member 220, and a regulation blade 236 in contact with the development roller 235.

The development roller 235 and the toner feed roller 233 are rotated in the direction opposite to the direction of rotation of the image holding member 220, as indicated by the arrows. On the other hand, the stirrer 231 is rotated in the direction opposite to the direction of rotation of the feed roller 233. The toner which has been stirred and held up with the stirrer 231 in the toner storage part 230 is fed to the toner feed roller 233 along the upper side of the partitioning member 232. The toner fed undergoes sliding friction with the charging blade 234, which is made of a flexible material. The toner is then fed to the surface of the development roller 235 based on adhesion to surface irregularities of the feed roller 233 by mechanical adhesive force and on adhesion to the roller surface by frictional electrostatic force.

The toner fed to the development roller 235 is regulated with the regulation blade 236 so as to form a thin layer having a given thickness. The resultant thin toner layer is conveyed toward the image holding member 220 and develops an electrostatic latent image on the image holding member 220 in the development zone where the development roller 235 faces close to the image holding member 220.

The paper feed unit 211 comprises: a paper cassette 238 in which sheets of a recording medium P are superposed and held; and a pickup roller 239 which, during image formation, takes out sheets of the recording medium P one by one from the paper cassette 238 and sends the sheets.

The paper-conveying unit 212 comprises: a pair of gate rollers 240 (one roller has been disposed on the housing 202 side) which determine the timing of feeding the recording medium P to the second-transfer part; a second-transfer roller 219 which is a second-transfer device pressed against the driving roller 213 and the intermediate transfer belt 215; a main recording medium conveyance passage 241; a fixing device 242; a pair of paper discharge rollers 243; and a conveyance passage 244 for double-side printing. The fixing device 242 comprises: a pair of fixing rollers 245 which are freely rotatable and at least one of which has a built-in heating element, e.g., a halogen heater; and a pressing device which presses at least one of the fixing rollers 245 against the other so as to press, against the recording medium P, the secondary image formed by second transfer to the recording medium P. The secondary image formed on the recording medium by second transfer is heated to a given temperature in the nip between the pair of fixing rollers 245 and thus fixed to the recording medium.

In this embodiment, since the intermediate transfer belt 215 has been disposed so as to be inclined to the left of the driving roller 213 in the figure, there is a large space on the right side. The fixing device 242 can be disposed in this space, whereby not only this image-forming apparatus can have a reduced size, but also the heat generated by the fixing device 242 can be prevented from adversely influencing components of the apparatus which are located on the left side, i.e., the exposure unit 207, intermediate transfer belt 215, and monochroic-image-forming units Y, M, C, and K.

Image-Forming Apparatus of the Second Invention

The second invention is based on the following finding concerning an image-forming apparatus in which electrostatic latent images on image holders are successively developed with toners of different colors and the resultant toner images are transferred to an intermediate transfer medium with the aid of a constant transfer voltage. When the image-forming apparatus in which the intermediate transfer medium contains an ion-conductive substance and has a work function smaller than the work function of each of the toners of different colors is used to successively develop the electrostatic latent images, then the generation of oppositely charged toners can be prevented and images having a high transfer efficiency can be formed.

FIG. 3 is a view illustrating an image-forming apparatus according to the second invention.

In FIG. 3 is shown one embodiment of an image-forming apparatus of the non-contact development type which employs toners according to the second invention.

The apparatus employs a photoreceptor 1 which is a photoreceptor drum having a diameter of from 24 to 86 mm and rotating at a peripheral speed of from 60 to 300 mm/s. The surface of the photoreceptor 1 is negatively charged evenly with a corona charging device 2 and then subjected to exposure 3 according to information to be recorded. Thus, an electrostatic latent image is formed.

A developing device 10, which is a device for development with a one-component toner, supplies a one-component nonmagnetic toner T to the organic photoreceptor, whereby the electrostatic latent image on the organic photoreceptor is made visible by reversal development. The developing device contains the one-component nonmagnetic toner T. As shown in the figure, the toner is supplied to a development roller 9 with a toner feed roller 7 rotating counter-clockwise. The development roller 9 rotates counter-clockwise and conveys the toner T, supplied with the toner feed roller 7, to the part for contact with the organic photoreceptor while holding the toner T on the surface thereof. The electrostatic latent image on the organic photoreceptor 1 is thus made visible.

The development roller 9 has a diameter of, for example, from 16 to 24 mm. It may be a roller obtained by subjecting a metallic pipe to plating or blasting, or may be one comprising a core and, formed on the periphery thereof, a conductive elastomer layer made of a butadiene rubber, styrene/butadiene rubber, ethylene/propylene rubber, urethane rubber, silicone rubber, or the like and having a volume resistivity of from $10^4$ to $10^8$ Ω·cm and a hardness of from 40 to 70° (Asker A hardness). A development bias voltage is applied through, e.g., the pipe core from a power source not shown. The developing device 10, which includes the development roller 9, the toner feed roller 7, and a toner regulation blade 8, is preferably pressed against the organic photoreceptor with an energizing device not shown, e.g., a spring, at a pressure of from 19.6 to 98.1 N/m, preferably from 24.5 to 68.6 N/m, so as to result in a nip width of from 1 to 3 mm.

As the regulation blade 8 may be used, for example, a stainless-steel, phosphor bronze, or rubber plate or a blade comprising a metal sheet and a rubber chip bonded thereto. It is preferred that the regulation blade 8 be pressed against the development roller with an energizing device not shown, e.g., a spring, or by means of the resilience of the elastomer at a linear pressure of from 245 to 490 mN/cm so as to make the toner on the development roller form about one or two layers.

In non-contact development, the photoreceptor is preferably regulated so as to have a dark potential of from −500 to −700 V and a light potential of from −50 to −150 V, and the development bias voltage not shown is preferably from −100 to −400 V. The development roller is preferably regulated so as to have the same potential as the toner feed roller.

In the non-contact development, the peripheral speed of the development roller, which rotates counter-clockwise, is desirably regulated to from 1.1 to 2.5 times, preferably from 1.2 to 2.2 times, the peripheral speed of the organic photoreceptor, which rotates clockwise. By thus regulating the peripheral speed of the development roller, even toner particles having a small particle diameter can be charged with the organic photoreceptor without fail.

There are no particular limitations on the relationship between the work function of each of the regulation blade and the development roller and the work function of the toner. Preferably, however, the regulation blade and the development roller each have a work function smaller than the work function of the toner so as to negatively charge the toner by contact with the regulation blade. Thus, the toner can be negatively charged more evenly. A voltage may be applied to the regulation blade 8 to inject charges into the toner in contact with the blade and thereby control the amount of charges on the toner.

The intermediate transfer medium in the image-forming apparatus of the second invention is explained next. As shown in FIG. 3, an intermediate transfer medium 4 is caused to run between the photoreceptor 1 and a back-up roller 6. A voltage is applied to the intermediate transfer medium 4, whereby the visible image on the photoreceptor 1 is transferred to the intermediate transfer medium. Thus, a toner image is formed on the intermediate transfer medium. The toner remaining on the photoreceptor is removed with a cleaning blade 5, and the electrostatic charges on the photoreceptor are erased with an erase lamp. The photoreceptor is then subjected to use again. Since the toner in the image-forming apparatus of the second invention can be inhibited from being reversely charged, the amount of the toner remaining on the photoreceptor can be reduced and the vessel for storing the toner recovered by cleaning can be made smaller.

In the case where the intermediate transfer medium is a transfer drum or transfer belt, a voltage of from +250 to +600 V is preferably applied as a first-transfer voltage to the conductive layer of the transfer medium. For second transfer, which is transfer to a receiving material such as paper, a voltage of from +400 to +2,800 V is preferably applied as a second-transfer voltage.

As the intermediate transfer medium can be used a transfer belt or transfer drum. The transfer belt may be one comprising a film or sheet base made of a synthetic resin and a transfer layer formed thereon or one comprising a base layer made of an elastic material and a transfer layer formed thereon as a surface layer. In the case where the photoreceptor is one comprising a rigid drum, e.g., an aluminum drum, and an organic photosensitive layer formed thereon, the transfer drum may be one comprising a rigid drum base made of, e.g., aluminum and an elastic transfer layer formed thereon as a surface layer. Furthermore, when the substrate of the photoreceptor is in a belt form or when the photoreceptor is a so-called elastic photoreceptor comprising an elastic substrate made of, e.g., a rubber and a photosensitive layer formed thereon, then a preferred transfer medium comprises a rigid drum base made of, e.g., aluminum and a transfer layer formed thereover directly or through a conductive interlayer.

As the base can be used a conductive or insulating base. In the case of a transfer belt, the volume resistivity thereof is preferably in the range of from $10^4$ to $10^{12}$ Ω·cm, more preferably from $10^6$ to $10^{11}$ Ω·cm.

Materials suitable for the intermediate transfer medium according to the second invention contain a polymeric substance having ionic conductivity. Such materials are obtained by dispersing fine particles of a polymer having ionic conductivity in a polymer having reduced moisture permeability. The proportion of the former to the latter polymer (by weight) is desirably from 85/15 to 40/60, preferably from 80/20 to 50/50.

In dispersing a polymer having ionic conductivity in a polymer having reduced moisture permeability, a chemical which vulcanizes the former polymer is added to a mixture obtained by kneading the two polymers together, and the resultant mixture is kneaded at a temperature of from 140° C. to 220° C. to thereby finely disperse the former polymer in the latter. The kneading can be conducted by a known method. For example, a kneading apparatus such as an open roll mill, Banbury mixer, or kneader is used. For the purpose of further reducing the diameter of the finely dispersed particles of the ion-conductive polymer, a compatibilizing agent may be added to regulate the particle diameter thereof.

In the case where the electrical resistance of the ion-conductive intermediate transfer medium is desired to be further lowered, an ionic-conductivity-imparting agent may be separately incorporated. Furthermore, besides the vulcanizing agent, a vulcanization accelerator and a vulcanization accelerator aid may be used; a suitable combination of the accelerator and aid with a vulcanizing agent may be used according to the ion-conductive polymer used.

Examples of the polymer having ionic conductivity include rubbers such as polyepichlorohydrin, poly(ethylene oxide)/epichlorohydrin copolymers, allyl glycidyl ether/ethylene oxide/epichlorohydrin copolymers, allyl glycidyl ether/poly(propylene oxide)/epichlorohydrin copolymers, acrylonitrile/butadiene copolymers, polychloroprene, acrylic rubbers, and urethane rubbers and thermoplastic elastomers such as styrene/isoprene/styrene block copolymers, hydrogenation products of these, styrene/butadiene/styrene copolymers, and hydrogenation products of these. Such polymers may be suitably used alone or in combination of two or more thereof.

Examples of the polymer having reduced moisture permeability include rubbers such as butyl rubbers, halogenated butyl rubbers, brominated copolymers of an alkylstyrene and isobutylene, ethylene/propylene copolymers and modifications thereof, ethylene/propylene/diene copolymers, chlorinated polyethylene, chlorosulfonated polyethylene, styrene/butadiene rubbers, polyisoprene, polynorbornene rubber, and polychloroprene and thermoplastic resins such as polyethylene, polypropylene, nylons, urethanes, poly(vinyl chloride), poly(vinylidene chloride), polycarbonates, and styrene/isoprene/styrene copolymers and hydrogenation products thereof. Preferred of these are butyl rubbers, halogenated butyl rubbers, brominated copolymers of an alkylstyrene and isobutylene, ethylene/propylene copolymers, and ethylene/propylene/diene copolymers.

As the vulcanizing agent can be used sulfur-containing compounds, organic peroxides, triazine compounds, and the like. As the vulcanization accelerator can be used guanidine compounds, thiourea compounds, dithiocarbamates, thiuram compounds, and the like. As the vulcanization accelerator aid can be used zinc oxide, magnesium oxide, stearic acid, triethanolamine, and the like.

In the case where a polymer which itself has no ionic conductivity is used, a polymer composition for an intermediate transfer medium having ionic conductivity can be obtained by adding an ionic-conductivity-imparting agent to a polymeric substance having reduced moisture permeability such as those shown above.

Examples of the ionic-conductivity-imparting agent include lithium perchlorate, sodium perchlorate, lithium chloride, lithium bromide, lithium iodide, lithium nitrate, lithium thiocyanate, sodium thiocyanate, lithium trifluoromethylnitrate, sodium bromide, sodium iodide, sodium thiocyanate, sodium perchlorate, sodium trifluoromethylsulfate, potassium iodide, potassium thiocyanate, potassium perchlorate, and the zinc salts, calcium salts, magnesium salts, and ammonium salts of these. A polymeric antistatic agent can be used in combination with the ionic-conductivity-imparting agent. Examples thereof include copolymers containing quaternary ammonium salt groups and polyetheresteramides.

A combination of any of those ion-conductive substances with any of the aforementioned polymeric substances having ionic conductivity may be used.

In producing a transfer belt, the mixture which has been kneaded and vulcanized in a kneading machine is taken out therefrom and molded by a known method, e.g., the continuous melt extrusion molding method, injection molding method, or blow molding method. According to need, surface polishing can be conducted to finish a transfer belt having a desired surface roughness.

In the case where a film or sheet is used to produce a base, a belt can be produced by conducting end jointing by ultrasonic welding. Specifically, a transfer belt having desired properties can be produced by forming a conductive layer and a surface layer on a film or sheet and then conducting ultrasonic welding.

When the development process shown in FIG. 3 is practiced on a combination of developing devices employing toners (developers) of four colors consisting of yellow Y, cyan C, magenta M, and black K with one or more photoreceptors, then an apparatus capable of forming a full-color image can be constituted.

Next, an explanation is given below on an image-forming apparatus according to the second invention to which negative electrification type dry toners are applied. FIG. 4 is a view illustrating one embodiment of a four-cycle full-color printer.

In FIG. 4, numeral 100 denotes an image holding member cartridge into which an image holding member unit has been incorporated. In this embodiment, a photoreceptor has been fabricated as a photoreceptor cartridge so as to be mounted separately from a development part unit. The electrophotographic photoreceptor (latent image holding member) 140 is rotated in the direction indicated by the arrow by means of an appropriate driving unit not shown. Around the photoreceptor 140 are disposed, along the direction of rotation thereof, a charging roller 160 as a charging device, developing devices 10 (Y, M, C, and K) as developing units, an intermediate transfer device 30, and a cleaning device 170.

The charging roller 160 is in contact with the peripheral surface of the photoreceptor 140 to evenly charge the peripheral surface. The evenly charged peripheral surface of the photoreceptor 140 is subjected to selective exposure L1 with an exposure unit 40 according to desired image information. As a result of this exposure L1, an electrostatic latent image is formed on the photoreceptor 140. This electrostatic latent image is developed with a developer by a developing device 10.

As developing devices have been disposed a developing device 10Y for yellow, developing device 10M for magenta, developing device 10C for cyan, and developing device 10K for black. These developing devices 10Y, 10C, 10M, and 10K each have been swingablly constituted so that the development roller 9 of one developing device only is selectively pressed against the photoreceptor 140. These developing devices 10 each hold a negatively charged toner on the development roller, and these developing devices 10 supply any one of toners of yellow Y, magenta M, cyan C, and black K to the surface of the photoreceptor 140 to develop the electrostatic latent image on the photoreceptor 140. The development rollers 9 each are constituted of a rigid roller, e.g., a metal roller having a roughened surface. The toner image developed is transferred to an intermediate transfer belt 36 of the intermediate transfer device 30. The cleaning device 170 comprises: a cleaner blade for scraping off the toner T attached to the peripheral surface of the photoreceptor 140 after the transfer; and a recovered-toner container for receiving the toner scraped off by the cleaner blade.

The intermediate transfer device 30 comprises a driving roller 31, four driven rollers 32, 33, 34, and 35, and an endless intermediate transfer belt 36 stretched around these rollers. The driving roller 31 has a gear not shown which has been fixed to an end thereof. This gear is engaged with a gear for driving the photoreceptor 140 so that the driving roller 31 is rotated at almost the same peripheral speed as the photoreceptor 140. Consequently, the intermediate transfer belt 36 is circulated in the direction indicated by the arrow at almost the same peripheral speed as the photoreceptor 140.

The driven roller 35is disposed in such a position that the intermediate transfer belt 36, in its part located between the driven roller 35and the driving roller 31, is pressed against the photoreceptor 140 by its own tension. Thus, the part at which the intermediate transfer belt 36 is pressed against the photoreceptor 140 constitutes a first-transfer part T1. The driven roller 35 is disposed near the first-transfer part T1 on the upstream side thereof with respect to the circulation of the intermediate transfer belt.

The driving roller 31 has an electrode roller not shown disposed through the intermediate transfer belt 36. A first-transfer voltage is applied through this electrode roller to the conductive layer of the intermediate transfer belt 36. The driven roller 32 is a tension roller and has an energizing device not shown, with which the intermediate transfer belt 36 is pushed in such a direction that the stretching thereof is enhanced. The driven roller 33 is a back-up roller which forms a second-transfer part T2. A second-transfer roller 38 has been disposed so as to face the back-up roller 33 through the intermediate transfer belt 36. A second-transfer voltage is applied to the second-transfer roller, which has been constituted so that the distance from the intermediate transfer belt 36 can be regulated with a gap-regulating mechanism not shown. The driven roller 34 is a back-up roller for a belt cleaner 39. The belt cleaner 39 has been constituted so that the distance from the intermediate transfer belt 36 can be regulated with a gap-regulating mechanism not shown.

The intermediate transfer belt 36 is constituted of a multilayer belt having a conductive layer and formed thereon a resistive layer to be pressed against the photoreceptor 140. The conductive layer has been formed on an insulating base made of a synthetic resin. A first-transfer voltage is applied to this conductive layer through the electrode roller. In edge parts of the belt, the resistive layer has been removed in strip areas to expose the conductive layer in the strip areas. The electrode roller comes into contact with the conductive layer in these exposed areas.

In the course of the circulation of the intermediate transfer belt 36, the toner image on the photoreceptor 140 is transferred to the intermediate transfer belt 36 in the first-transfer part T1, and the toner image transferred to the intermediate transfer belt 36 is transferred in the second-transfer part T2 to a recording medium S, e.g., paper, supplied to the nip between the intermediate transfer belt 36 and the second-transfer roller 38. The sheet S is supplied from a paper feeder 50; the sheet S is introduced into the second-transfer part T2 with a given timing by means of a pair of gate rollers G. Numeral 51 denotes a paper cassette and 52 denotes a pickup roller.

The toner image is fixed in a fixing device 60, and the sheet S is passed through a paper discharge passage 70 and discharged onto a sheet-receiving part 81 on a housing 80 of the apparatus main body. This image-forming apparatus has two independent paper discharge passages 71 and 72 as paper discharge passages 70. A sheet which has passed through the fixing device 60 is discharged through one of the paper discharge passages 71 and 72. The paper discharge passages 71 and 72 include a switchback passage so that when an image is to be formed on both sides of a sheet, the sheet which has once entered the paper discharge passage 71 or 72 can be supplied again to the second-transfer part T2 through return rollers 73.

The whole operations of the image-forming apparatus described above are summarized below.

(1) When image information is sent from, e.g., a personal computer not shown to a control unit 90 of the image-forming apparatus, then the photoreceptor 140, the rollers 9 of the respective developing devices 10, and the intermediate transfer belt 36 are rotated or circulated.

(2) The peripheral surface of the photoreceptor 140 is evenly charged by the charging roller 160.

(3) The evenly charged peripheral surface of the photoreceptor 140 is subjected to selective exposure L1 according to image information on a first color (e.g., yellow) with the exposure unit 40 to form an electrostatic latent image for yellow.

(4) The development roller of only the developing device for a first color, e.g., the developing device 10Y for yellow, is brought into contact with the photoreceptor 140. The electrostatic latent image is thus developed and a toner image of yellow as the first color is formed on the photoreceptor 140.

(5) A first-transfer voltage having the polarity opposite to the charge polarity of the toner is applied to the intermediate transfer belt 36, and the toner image formed on the photoreceptor 140 is transferred to the intermediate transfer belt 36 in the first-transfer part T1. During this transfer, the second-transfer roller 38 and the belt cleaner 39 are kept apart from the intermediate transfer belt 36.

(6) The toner remaining on the photoreceptor 140 is removed by the cleaning device 170. Thereafter, any residual charges are removed from the photoreceptor 140 with a charge erase light L2 emitted from an eraser 41.

(7) The operations (2) to (6) are repeated according to need. Namely, the operations are repeated for second, third, and fourth colors according to printing command signals, and toner images in accordance with the printing command signals are formed on the intermediate transfer belt 36 so as to be superposed on one another.

(8) A sheet S is supplied from the paper feeder 50 with a given timing. The second-transfer roller 38 is brought into contact with the intermediate transfer belt 36, just before the front end of the sheet S reaches the second-transfer part T2 or after the front end reaches the part T2, i.e., with such a timing that the toner images on the intermediate transfer belt 36 can be transferred to given positions on the sheet S. As a result, the toner images on the intermediate transfer belt 36, i.e., a full-color image formed by the superposed toner images of four colors, are transferred to the sheet S. Furthermore, the belt cleaner 39 is brought into contact with the intermediate transfer belt 36 to remove the toners remaining on the intermediate transfer belt 36 after the second transfer.

(9) The recording medium S passes through the fixing device 60, whereby the toner images on the sheet S are fixed. Thereafter, the sheet S is conveyed toward a given position (toward the sheet-receiving part 81 in the case of one-side printing, or toward the return rollers 73 through the switch-back passage 71 or 72 in the case of double-side printing).

In this image-forming apparatus according to the second invention, the development rollers 9 and the intermediate transfer medium 36 may be kept in contact with the photoreceptor 140, or the development may be non-contact development.

Figure 8:
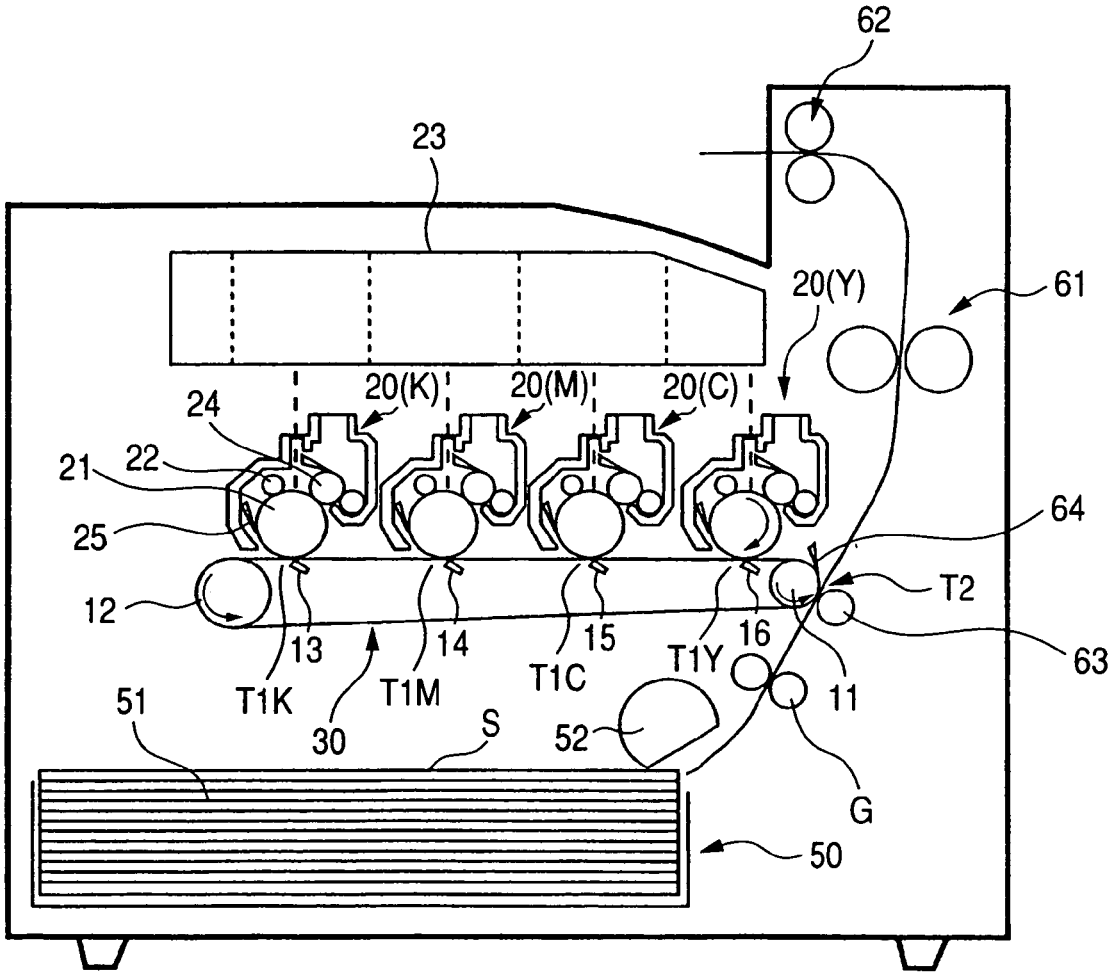
FIG. 8 is a view illustrating one embodiment of a tandem full-color printer according to the second invention.

A diagrammatic front view of a tandem full-color printer according to the second invention is shown in FIG. 8. In this embodiment, each photoreceptor has been united with the corresponding development part unit so that the two components can be mounted as the same unit, i.e., as a process cartridge. Although development in this embodiment is contact development, non-contact development also can be employed.

This image-forming apparatus has: an intermediate transfer belt 30, which is stretched with only two rollers, i.e., a driving roller 11 and a driven roller 12, and is circulated in the direction indicated by the arrows (counter-clockwise); and four monochroic-toner-image-forming devices 20(Y), 20(C), 20(M), and 20(K) disposed beside the intermediate transfer belt 30. This apparatus has been constituted so that toner images formed by the monochroic-toner-image-forming devices 20 are successively transferred firstly to the intermediate transfer belt 30 with transfer devices 13, 14, 15, and 16 separately disposed. The first-transfer parts where such transfer takes place are indicated by T1Y, T1C, T1M, and T1K, respectively.

The monochroic-toner-image-forming devices disposed are one for yellow 20(Y), one for magenta 20(M), one for cyan 20(C), and one for black 20(K). These monochroic-toner-image-forming devices 20(Y), 20(C), 20(M), and 20(K) each comprise: a photoreceptor 21 having a photosensitive layer on its periphery; a charging roller 22 as a charging device for evenly charging the peripheral surface of this photoreceptor 21; an exposure device 23 which selectively illuminates the peripheral surface evenly charged by the charging roller 22 to form an electrostatic latent image; a development roller 24 as a developing device which imparts a developer or toner to the electrostatic latent image formed by the exposure device 23 to thereby form a visible image (toner image); and a cleaning blade 25 as a cleaning device which removes the toner remaining on the surface of the photoreceptor 21 after the toner image formed by development with the development roller 24 is transferred to the intermediate transfer medium 30 on which first transfer takes place.

These monochroic-toner-image-forming devices 20(Y), 20(C), 20(M), and 20(K) have been disposed on the loosening side of the intermediate transfer belt 30. Monochroic toner images respectively formed by these image-forming devices 20 are successively transferred firstly to the intermediate transfer belt 30 and successively superposed on the intermediate transfer belt 30 to form full-color toner images, which are secondly transferred in a second-transfer part T2 to a recording medium S such as paper. This recording medium S is passed through a pair of fixing rollers 61, whereby the toner images are fixed to the recording medium S. The recording medium S is then discharged with a pair of paper discharge rollers 62 to a given area, e.g., to a discharged-paper tray not shown. Numeral 51 denotes a paper cassette, in which sheets of the recording medium S are superposed and held; 52 denotes a pickup roller, which takes out sheets of the recording medium S one by one from the paper cassette 51 and sends the sheets; and G denotes a pair of gate rollers, which determine the timing of feeding the recording medium S to the second-transfer part T2.

Numeral 63 denotes a second-transfer roller as a second-transfer device which forms the second-transfer part T2 at the nip between it and the intermediate transfer belt 30. Numeral 64 denotes a cleaning blade as a cleaning device for removing residual toners remaining on the surface of the intermediate transfer belt 30 after second transfer. After second transfer, the cleaning blade 64 is kept in contact with the intermediate transfer belt 30 in that part of the intermediate transfer belt 30 which is wound around not the driven roller 12 but the driving roller 11.

In the second invention, a difference in the sequence of toner deposition for development is thought to bring about the following difference in transfer efficiency.

FIGS. 1 are views illustrating toners superposed on an intermediate transfer medium according to the invention.

FIG. 1(A) shows the case in which a solid image is transferred. The figure shows toners arranged in a row. The toners have been deposited for development and transferred in descending order of work function, and are electrostatically attached to the intermediate transfer belt. Electrons (charges) move in the direction indicated by the arrow and the uppermost toner comes to have a reduced charge amount. In constant-voltage transfer, the direction of the flow of charges is hence the same as the direction of transfer. This is thought to bring about an increased transfer efficiency.

FIG. 1(B) shows the case in which a half-tone image is transferred. In this case, the toners are arranged adjacently. The toners have been deposited for development and transferred in descending order of work function, and are electrostatically attached to the intermediate transfer belt. In this case also, electrons (charges) move in the direction indicated by the arrow and the uppermost toner comes to have a reduced charge amount. In constant-voltage transfer, the direction of the flow of charges is hence the same as the direction of transfer. This is thought to bring about an increased transfer efficiency.

Determination of Work Function

An explanation is given below on an examination cell for use in determining the work functions of toners.

FIG. 6 is views illustrating a sample examination cell for work function determination.

Figure 6A:
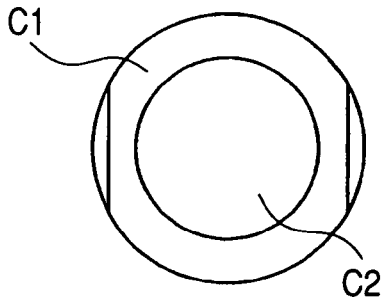
FIGS. 6A–6B are views illustrating a sample examination cell for use in determining work function.
Figure 6B:
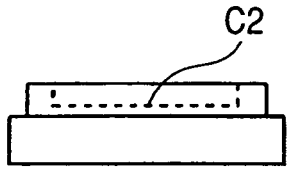

FIG. 6(A) is a plan view and FIG. 6(B) is a side view. As shown in these figures, the sample examination cell C1 has a shape comprising a stainless-steel disk which has a diameter of 13 mm and a height of 5 mm and has in a central part thereof a recess C2 for toner placement which has a diameter of 10 mm and a depth of 1 mm. A toner is placed in the recess of the cell with a weighing spoon without compacting, and the surface of the toner placed is leveled with a knife edge. The toner in this state is subjected to a measurement.

The examination cell filled with the toner is fixed to a given position on a sample table. Thereafter, a measurement is made under the conditions of an irradiation area of 4 mm square and an energy scanning range of from 4.2 to 6.2 eV.

With respect to the quantity of irradiation light, materials having high insulating properties, such as toners, and semiconductive materials were examined at an irradiation light quantity of 500 nW. In the case of conductive materials such as metallic materials, measurements were made at an irradiation light quantity of 10 nW.

In measurements for determining the work functions of toners, the normalized electron yield is preferably regulated to 8 or more at an irradiation light quantity of 500 nW.

FIG. 7 is views for illustrating a method of determining the work function of a sample of another shape.

Figure 7A:
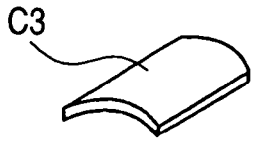
FIGS. 7A–7B are views for illustrating a method of determining work function.
Figure 7B:
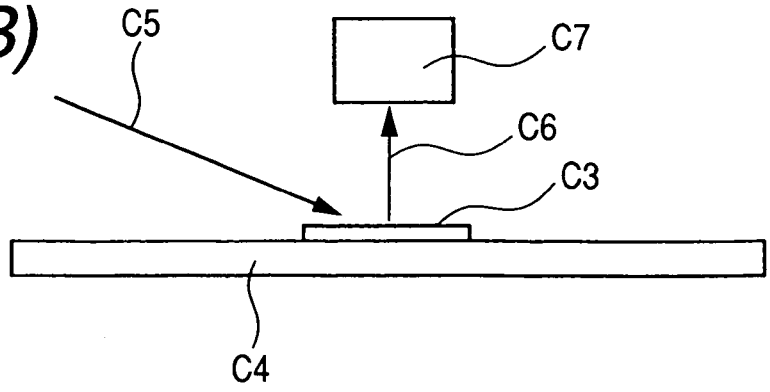

In the case where a cylindrical member such as an intermediate transfer medium or latent image holding member is to be used as a sample, the cylindrical member is cut into a width of about from 1 to 1.5 cm and then cut in the transverse direction, i.e., along ridges, to obtain a sample piece C3 to be examined which has the shape shown in FIG. 7(A). Thereafter, the sample piece C3 is fixed to a given position on a sample table C4 so that the sample surface to be illuminated is parallel to the direction from which a light C5 used for the measurement strikes, as shown in FIG. 7(B). Thus, photoelectrons C6 released are efficiently detected by a detector C7, i.e., a photomultiplier.

Toner for Use in the Apparatus of the Present Invention

The toners to be used in the invention may be ones obtained by either the pulverization method or the polymerization method. However, polymerization-method toners are preferred because they have a satisfactory roundness.

A pulverization-method toner can be produced by incorporating at least a pigment into a resin binder, adding a release agent, charge control agent, etc. thereto, evenly mixing the ingredients by means of a Henschel mixer or the like, melt-kneading the resultant mixture with a twin-screw extruder, cooling the extrudate, subjecting it to a crushing-pulverization step and then to classification, and then adhering external-additive particles to the resultant powder to obtain toner particles.

As the binder resin can be used synthetic resins in use for toners. Examples thereof include styrene resins which are homopolymers or copolymers comprising styrene units or substituted-styrene units, such as polystyrene, poly(α-methylstyrene), chloropolystyrene, styrene/chlorostyrene copolymers, styrene/propylene copolymers, styrene/butadiene copolymers, styrene/vinyl chloride copolymers, styrene/vinyl acetate copolymers, styrene/maleic acid copolymers, styrene/acrylic ester copolymers, styrene/methacrylic ester copolymers, styrene/acrylic ester/methacrylic ester copolymers, styrene/methyl α-chloroacrylate copolymers, styrene/acrylonitrile/acrylic ester copolymers, and styrene/vinyl methyl ether copolymers. Examples thereof further include polyester resins, epoxy resins, urethane-modified epoxy resins, silicone-modified epoxy resins, vinyl chloride resins, rosin-modified maleic acid resins, phenyl resins, polyethylene, polypropylene, ionomer resins, polyurethane resins, silicone resins, ketone resins, ethylene/ethyl acrylate copolymers, xylene resins, poly(vinyl butyral) resins, terpene resins, phenolic resins, and aliphatic or alicyclic hydrocarbon resins. These resins may be used alone or in combination of two or more thereof.

Especially preferred in the invention are styrene/acrylic ester resins, styrene/methacrylic ester resins, and polyester resins. Preferred binder resins are ones having a glass transition temperature in the range of from 50 to 75° C. and a flow/softening temperature in the range of from 100 to 150° C.

As the colorant can be used colorants for toners. Examples thereof include dyes and pigments such as carbon blacks, lamp black, magnetite, titanium black, chrome yellow, ultramarine, aniline blue, Phthalocyanine Blue, Phthalocyanine Green, Hansa Yellow G, Rhodamine 6G, Calco Oil Blue, quinacridone, Benzidine Yellow, Rose Bengal, Malachite Green Lake, Quinoline Yellow, C.I. Pigment Red 48:1, C.I. Pigment Red 122, C.I. Pigment Red 57:1, C.I. Pigment Red 122, C.I. Pigment Red 184, C.I. Pigment Yellow 12, C.I. Pigment Yellow 17, C.I. Pigment Yellow 97, C.I. Pigment Yellow 180, C.I. Solvent Yellow 162, C.I. Pigment Blue 5:1, and C.I. Pigment Blue 15:3. These dyes and pigments may be used alone or in combination of two or more thereof.

As the release agent can be used release agents for toners. Examples thereof include paraffin waxes, microwaxes, microcrystalline waxes, candelilla wax, carnauba wax, rice wax, montan wax, polyethylene wax, polypropylene wax, oxidizing type polyethylene wax, and oxidizing type polypropylene wax. Preferred of these are polyethylene wax, polypropylene wax, carnauba wax, ester waxes, and the like.

As the charge control agent can be used charge control agents for toners. Examples thereof include Oil Black, Oil Black BY, and Bontron S-22 and S-34 (manufactured by Orient Chemical Industries Ltd.), salicylic acid metal complexes E-81 and E-84 (manufactured by Orient Chemical Industries Ltd.), thioindigo pigments, sulfonylamine derivatives of copper phthalocyanine, Spilon Black TRH (manufactured by Hodogaya Chemical Co., Ltd.), calixarene compounds, organoboron compounds, fluorine-containing quaternary ammonium salt compounds, monoazo metal complexes, aromatic hydroxycarboxylic acid metal complexes, aromatic dicarboxylic acid metal complexes, and polysaccharides. For use in color toners, colorless or white charge control agents are preferred of these.

In pulverization-method toners, ingredients proportions per 100 parts by weight of the binder resin are as follows. The proportion of the colorant is generally from 0.5 to 15 parts by weight, preferably from 1 to 10 parts by weight, that of the release agent is generally from 1 to 10 parts by weight, preferably from 2.5 to 8 parts by weight, and that of the charge control agent is generally from 0.1 to 7 parts by weight, preferably from 0.5 to 5 parts by weight.

From the standpoint of improving transfer efficiency, the pulverization-method toners to be used in the invention preferably are subjected to a rounding treatment. This can be accomplished by conducting a pulverization step with an apparatus capable of yielding pulverized particles which are relatively round. For example, when Turbo Mill (manufactured by Turbo Industries, Ltd.), which is known as a mechanical pulverizer, is used in the step, a roundness increased to 0.93 can be obtained. Alternatively, a toner pulverized may be treated with a hot-air rounding apparatus (manufactured by Nippon Pneumatic Mfg. Co., Ltd.), whereby a roundness increased to 1.00 can be obtained.

In the invention, values of the average particle diameter and roundness of toner particles were obtained through measurements with a particle image analyzer (FPIA 2100, manufactured by Sysmex Corp.).

Examples of the polymerization-method toners include toners obtained by the suspension polymerization method, emulsion polymerization method, and dispersion polymerization method. In the suspension polymerization method, a monomer composition which comprises one or more polymerizable monomers, a coloring pigment, and a release agent and optionally further contains a dye, polymerization initiator, crosslinking agent, charge control agent, and other additives dissolved or dispersed therein is added to an aqueous phase containing a suspension stabilizer (a water-soluble polymer or sparingly water-soluble inorganic substance) with stirring to form particles of the composition and polymerized. Thus, colored toner particles having a desired particle size can be formed through polymerization.

In the emulsion polymerization method, one or more monomers and a release agent are dispersed in water optionally together with a polymerization initiator, emulsifying agent (surfactant), etc., and polymerized. In a subsequent coagulation step, a colorant, charge control agent, coagulant (electrolyte), and the like are added, whereby colored toner particles having a desired particle size can be formed.

Among the materials to be used in the production of polymerization-method toners, the colorant, release agent, and charge control agent can be the same as those for use in producing the pulverized toners described above.

As the polymerizable monomer ingredients can be used known vinyl monomers. Examples thereof include styrene, o-methylstyrene, m-methylstyrene, p-methylstyrene, α-methylstyrene, p-methoxystyrene, p-ethylstyrene, vinyltoluene, 2,4-dimethylstyrene, p-n-butylstyrene, p-phenylstyrene, p-chlorostyrene, divinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethylhexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethylhexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalic anhydride, ethylene, propylene, butylene, isobutylene, vinyl chloride, vinylidene chloride, vinyl bromide, vinyl fluoride, vinyl acetate, vinyl propionate, acrylonitrile, methacrylonitrile, vinyl methyl ether, vinyl ethyl ether, vinyl ketone, vinyl hexyl ketone, and vinylnaphthalene. Fluorine-containing monomers such as, e.g., 2,2,2-trifluoroethyl acrylate, 2,2,3,3-tetrafluoropropyl acrylate, vinylidene fluoride, trifluoroethylene, tetrafluoroethylene, and trifluoropropylene are usable because fluorine atoms are effective in controlling negative charges.

Examples of the emulsifying agent (surfactant) include sodium dodecylbenzenesulfate, sodium tetradecyl sulfate, sodium pentadecyl sulfate, sodium octyl sulfate, sodium oleate, sodium laurate, calcium stearate, calcium oleate, dodecylammonium chloride, dodecylammonium bromide, dodecyltrimethylammonium bromide, dodecylpyridinium chloride, hexadecyltrimethylammonium bromide, dodecyl polyoxyethylene ether, hexadecyl polyoxyethylene ether, lauryl polyoxyethylene ether, and sorbitan monooleate polyoxyethylene ether.

Examples of the polymerization initiator include potassium persulfate, sodium persulfate, ammonium persulfate, hydrogen peroxide, 4,4'-azobiscyanovaleric acid, t-butyl hydroperoxide, benzoyl peroxide, and 2,2'-azobisisobutyronitrile.

Examples of the coagulant (electrolyte) include sodium chloride, potassium chloride, lithium chloride, magnesium chloride, calcium chloride, sodium sulfate, potassium sulfate, lithium sulfate, magnesium sulfate, calcium sulfate, zinc sulfate, aluminum sulfate, and iron sulfate.

A technique for regulating the roundness of a polymerization-method toner in the emulsion polymerization method is to regulate the temperature for and time period of the coagulation step for yielding secondary particles. By this technique, the roundness can be varied at will in the range of from 0.94 to 1.00. In the suspension polymerization method, a truly spherical toner can be produced and, hence, a roundness in the range of from 0.98 to 1.00 is attainable. Furthermore, toner particles can be thermally deformed at a temperature not lower than the $T_g$ of the toner in order to regulate the roundness. By this technique, the roundness can be regulated at will in the range of from 0.94 to 0.98.

The number-average particle diameter of each toner is preferably 9 μm or smaller, more preferably from 8 μm to 4.5 μm. Toners having a number-average particle diameter larger than 9 μm are undesirable because use of such toners in developing latent images at a resolution as high as 1,200 dpi or above results in lower reproducibility of the resolution than in development with toners having small particle diameters. On the other hand, toners having a number-average particle diameter smaller than 4.5 μm are undesirable because not only such toners have reduced hiding power but also they necessitate use of a larger amount of an external additive for enhancing flowability and this tends to result in reduced fixability.

External additives are explained next. The toner particles to be used in the invention preferably contain, as external additives, silica particles and surface-modified silica particles obtained by modifying the surface of silica with an oxide or hydroxide of at least one metal selected from titanium, tin, zirconium, and aluminum. The amount of the surface-modified silica particles is up to 1.5 times by weight the amount of the silica particles.

As other external additives can be used various, inorganic and organic flowability improvers for toners. For example, use can be made of fine particles of positively electrifiable silica, titanium dioxide, alumina, zirconium oxide, magnetite, zinc oxide, calcium carbonate, magnesium carbonate, magnesium fluoride, silicon carbide, boron carbide, titanium carbide, zirconium carbide, boron nitride, titanium nitride, zirconium nitride, molybdenum disulfide, aluminum stearate, magnesium stearate, zinc stearate, calcium stearate, a metal titanate such as strontium titanate, or a metal silicate. It is preferred that such fine particles be used after having been hydrophobized with a silane coupling agent, titanate coupling agent, higher fatty acid, silicone oil, or the like. Other examples of fine particles include fine particles of resins such as acrylic resins, styrene resins, and fluororesins. Such flowability improvers may be used alone or as a mixture of two or more thereof. The amount of the flowability improver to be used is preferably from 0.1 to 5 parts by weight, more preferably from 0.5 to 4.0 parts by weight, per 100 parts by weight of the toner.

The silica particles may be either ones produced by a dry process from a halide or another compound of silicon or ones precipitated by a wet process from a silicon compound in a liquid.

The average primary-particle diameter of the silica particles is preferably from 7 to 40 nm, more preferably from 10 to 30 nm. Silica particles having an average primary-particle diameter smaller than 7 nm are apt to be embedded in the main particles of the toner and to cause the toner to be overcharged negatively. On the other hand, silica particles having an average primary-particle diameter exceeding 40 nm are disadvantageous because the effect of imparting flowability to main toner particles is impaired to make it difficult to negatively charge the toner evenly and this tends to result in an increase in the amount of toner particles charged oppositely, i.e., positively.

It is preferred in the invention to use as the silica particles a mixture of silicas differing in number-average particle diameter. The incorporation of an external additive having a large particle diameter prevents external-additive embedment in the toner particles, while silica particles having a small diameter impart favorable flowability.

Specifically, it is preferred to use a combination of silicas in which one of the silicas has a number-average primary-particle diameter of preferably from 5 to 20 nm, more preferably from 7 to 16 nm, and the other silica has a number-average primary particle diameter of preferably from 30 to 50 nm, more preferably from 30 to 40 nm.

The particle diameters of those external additives in the invention are values obtained through examination with an electron microscope, and the average particle diameters are number-average particle diameters.

The silica particles to be used as an external additive in the invention preferably are hydrophobized with a silane coupling agent, titanate coupling agent, higher fatty acid, silicone oil, or the like before use. Examples of such hydrophobizing agents include dimethyldichlorosilane, octyltrimethoxysilane, hexamethyldisilazane, silicone oils, octyltrichlorosilane, decyltrichlorosilane, nonyltrichlorosilane, (4-isopropylphenyl)trichlorosilane, (4-t-butylphenyl) trichlorosilane, dipentyldichlorosilane, dihexyldichlorosilane, dioctyldichlorosilane, dinonyldichlorosilane, didecyldichlorosilane, didodecyldichlorosilane, (4-t-butylphenyl)octyldichlorosilane, didecenyldichlorosilane, dinonenyldichlorosilane, di-2-ethylhexyldichlorosilane, di-3,3-dimethylpentyldichlorosilane, trihexylchlorosilane, trioctylchlorosilane, tridecylchlorosilane, dioctylmethylchlorosilane, octyldimethylchlorosilane, and (4-isopropylphenyl)diethylchlorosilane.

It is also preferred to use silica particles in combination with a given amount of silica whose surface has been modified with a metal compound. This surface-modified silica is one obtained by coating silica particles having a specific surface area of from 50 to 400 $m^2/g$ with a hydroxide or oxide of at least one member selected from titanium, tin, zirconium, and aluminum.

In preparing the surface-modified silica, 100 parts by weight of silica particles are coated with from 1 to 30 parts by weight of the hydroxide or oxide to prepare a slurry. Subsequently, from 3 to 50 parts by weight of an alkoxysilane is used for coating per 100 parts by weight of the solid ingredients in the slurry. Thereafter, the slurry is neutralized with an alkali and filtered, and the particles recovered are washed, dried, and pulverized to thereby obtain the surface-modified silica. The fine silica particles to be used for producing the surface-modified silica may be particles produced by either a wet process or a gas-phase process.

For the surface modification of silica particles, use can be made of an aqueous solution containing at least one of titanium, tin, zirconium, and aluminum. Examples of usable compounds of these metals include titanium sulfate, titanium tetrachloride, tin chloride, stannous sulfate, zirconium oxychloride, zirconium sulfate, zirconium nitrate, aluminum sulfate, and sodium aluminate.

The surface modification of silica particles with an oxide or hydroxide of any of those metals can be conducted by treating a slurry of the silica particles with an aqueous solution of a compound of the metal. This treatment is preferably performed at a temperature of from 20 to 90° C.

Subsequently, a hydrophobizing treatment is conducted by coating with an alkoxysilane. This hydrophobizing treatment can be accomplished by regulating the pH of the slurry to 2 to 6, preferably 3 to 6, subsequently adding from 30 to 50 parts by weight of at least one alkoxysilane per 100 parts by weight of the fine silica particles, and then regulating the temperature of the resultant slurry to 20 to 100° C., preferably 30 to 70° C., to conduct hydrolysis and condensation reactions.

It is preferred that after the addition of the alkoxysilane, the slurry be stirred and the pH thereof be then regulated to 4 to 9, preferably 5 to 7, to accelerate the condensation reaction. For the pH regulation can be used sodium hydroxide, potassium hydroxide, sodium carbonate, ammonia water, ammonia gas, or the like. By thus performing the treatment, stable fine particles which have been evenly hydrophobized are obtained.

Subsequently, the slurry is filtered and the solid matter recovered is washed with water and then dried. Thus, surface-modified fine silica particles can be obtained.

The drying may be conducted at from 100 to 190° C., preferably from 110 to 170° C. Temperatures lower than 100° C. are undesirable because the drying efficiency is low and a reduced degree of hydrophobicity results. Temperatures exceeding 190° C. are undesirable because hydrocarbon groups are pyrolyzed, resulting in discoloration and a reduced degree of hydrophobicity.

A hydrophobizing treatment may be conducted by adding an alkoxysilane to surface-modified silica particles and then treating the resultant mixture with a Henschel mixer or the like to coat the silica particles.

Those external additives in the invention may be added preferably in an amount of from 0.05 to 2 parts by weight per 100 parts by weight of the main toner particles.

In case where the amount of the external additives is smaller than 0.05 parts by weight, the addition thereof is ineffective in flowability impartation and overcharge prevention. Conversely, in case where the amount thereof exceeds 2 parts by weight, not only the amount of negative charges decreases but also the amount of positively charged toner particles, which are oppositely charged particles, increases, resulting in enhanced fog and an increased amount of a reversely transferred toner.

EXAMPLES

The present invention will be illustrated in greater detail with reference to the following Examples, but the invention should not be construed as being limited thereto.

Firstly, Examples of the first invention are described below.

Production Example for Toner 1A

A monomer mixture consisting of 80 parts by weight of styrene monomer, 20 parts by weight of butyl acrylate, and 5 parts by weight of acrylic acid was added to an aqueous solution mixture consisting of 105 parts by weight of water, 1 part by weight of a nonionic emulsifying agent (Emulgen 950, manufactured by Dai-ichi Kogyo Seiyaku Co., Ltd.), 1.5 parts by weight of an anionic emulsifying agent (Neogen R, manufactured by Dai-ichi Kogyo Seiyaku Co., Ltd.), and 0.55 parts by weight of potassium persulfate. Polymerization was conducted at 70° C. for 8 hours with stirring in a nitrogen stream. After the polymerization reaction, the reaction mixture was cooled to obtain a milk-white resin emulsion having a particle diameter of 0.25 μm.

Subsequently, 200 parts by weight of the resin emulsion, 20 parts by weight of a polyethylene wax emulsion (manufactured by Sanyo Chemical Industries, Ltd.), and 7 parts by weight of Phthalocyanine Blue were dispersed in water containing 0.2 parts by weight of sodium dodecylbenzenesulfonate as a surfactant. Diethylamine was added to the dispersion to adjust the pH thereof to 5.5. Thereafter, 0.3 parts by weight of aluminum sulfate as an electrolyte was added to the dispersion with stirring, and the resultant mixture was agitated for dispersion with an agitator (TK Homomixer) at a high speed.

Thereto were further added 40 parts by weight of styrene monomer, 10 parts by weight of butyl acrylate, and 5 parts by weight of zinc salicylate together with 40 parts by weight of water. In a nitrogen stream, an aqueous hydrogen peroxide solution was added to the mixture and polymerization was conducted in the same manner for 5 hours with stirring and heating at 90° C. to grow the particles. After termination of the polymerization, the reaction mixture was heated to 95° C. and held for 5 hours while regulating the pH thereof to 5 or higher in order to increase the bonding strength of association particles.

The particles obtained were washed with water and vacuum-dried at 45° C. for 10 hours. Thus, a cyan toner having an average particle diameter of 6.8 μm and a roundness of 0.98 was obtained.

In this Example, roundness was determined through a measurement with a flow type particle image analyzer (FPIA 2100, manufactured by Sysmex Corp.) and shown in terms of the following expression (1):

$$R=L_0/L_1 \quad (1)$$

wherein $L_1$ is the peripheral length (μm) of a projected image of a toner particle being examined; and $L_0$ is the peripheral length (μm) of the complete circle equal in area to the projected image of the toner particle being examined.

To the toner obtained were added 1% by weight hydrophobic silica having an average primary-particle diameter of 12 nm and 0.7% by weight hydrophobic silica having an average primary-particle diameter of 40 nm as flowability improvers. These ingredients were mixed together. Subsequently, 0.5% by weight hydrophobic titanium oxide having an average primary-particle diameter of about 20 nm and 0.4% by weight positively electrifiable hydrophobic silica obtained by treating the surface of hydrophobic silica having an average primary-particle diameter of about 30 nm with aminosilane were added to the mixture. These ingredients were mixed together. Thus, toner 1A was obtained.

Average particle diameter is shown in terms of volume distribution D50 determined with an electric-resistance particle size distribution analyzer (Multisizer III, manufactured by Beckman-Coulter Inc.).

The toner obtained had a work function of 5.54 eV. In this Example, the value of work function was obtained through examination with a surface analyzer (Type AC-2, manufactured by Riken Keiki Co., Ltd.) at a quantity of irradiation light of 500 nW.

Production Example for Toner 2A

The same procedure as in Production Example for Toner 1A was conducted, except that quinacridone was used in place of Phthalocyanine Blue as a pigment and that the heating for enhancing association for secondary-particle formation and bonding strength for film formation was conducted at a temperature of 90° C. Thus, toner 2A was produced. The magenta toner obtained had a roundness of 0.972 and a work function of 5.63 eV. This toner had a number-average particle diameter of 6.9 μm.

Production Example for Toners 3A and 4A

Polymerization was conducted in the same manner as in Production Example for Toner 2A, except that Pigment Yellow 180 or carbon black was used in place of the pigment used in Production Example for Toner 2A. Flowability improvers were added to the resultant toners in the same manner as in Production Example for Toner 2A. Thus, yellow toner 3A having a roundness of 0.972, work function of 5.58 eV, and average particle diameter of 7.0 μm and black toner 4A having a roundness of 0.973, work function of 5.48 eV, and average particle diameter of 6.9 μm were produced.

Production Example for Organic Photoreceptor (OPC1A)

A coating fluid prepared by dissolving or dispersing 6 parts by weight of an alcohol-soluble nylon (CM8000, manufactured by Toray Industries, Inc.) and 4 parts by weight of aminosilane-treated fine titanium oxide particles in 100 parts by weight of methanol was applied by the ring coating method on a conductive base having a diameter of 85.5 mm coated with 40 μm-thick nickel by electroforming. The coating fluid applied was dried at a temperature of 100° C. for 40 minutes to form an undercoat layer having a thickness of 1.5 μm.

A mixture consisting of 1 part by weight of oxytitanylphthalocyanine as a charge generator, 1 part by weight of a butyral resin (BX-1, manufactured by Sekisui Chemical Co., Ltd.), and 100 parts by weight of dichloroethane was treated for 8 hours with a sand mill employing glass beads having a diameter of 1 mm to disperse the pigment.

The pigment dispersion obtained was applied to the undercoat layer on the base by the ring coating method. The dispersion applied was dried at 80° C. for 20 minutes to form a charge-generating layer having a thickness of 0.3 μm.

In 400 parts by weight of toluene were dissolved 40 parts by weight of the styryl compound of the following structural formula (1) as a charge-transporting substance and 60 parts by weight of a polycarbonate resin (Panlite TS, manufactured by Teijin Chemicals Ltd.). This solution was applied to the charge-generating layer by dip coating in a thickness of 22 μm on a dry basis, and dried to form a charge-transporting layer. Thus, an organic photoreceptor (OPC1A) having a photosensitive layer composed of two layers was produced.

Part of the organic photoreceptor obtained was cut out as a sample piece and examined for work function with a surface analyzer (Type AC-2, manufactured by Riken Keiki Co., Ltd.) at a quantity of irradiation light of 500 nW. As a result, the work function thereof was found to be 5.47 eV.

Structural formula (1)

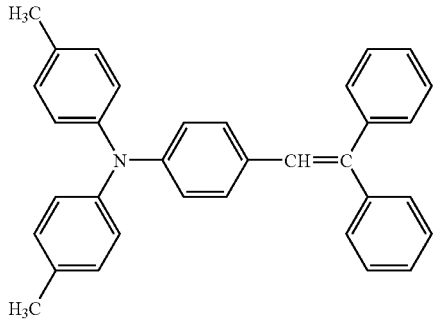

Production Example for Organic Photoreceptor (OPC2A)

An organic photoreceptor (OPC2A) was produced in the same manner as for the organic photoreceptor (OPC1A), except that an aluminum pipe having a diameter of 30 mm was used as a conductive base and that the charge generator and the charge-transporting substance were replaced by titanylphthalocyanine and the distyryl compound of the following structural formula (2), respectively.

The work function of this organic photoreceptor was determined in the same manner and was found to be 5.50 eV.

Structural formula (2)

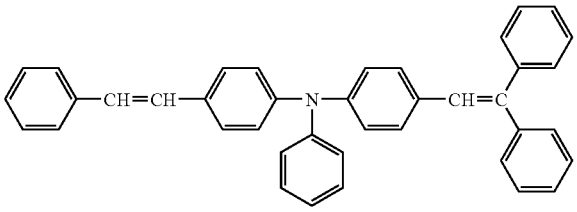

Production of Development Roller

The surface of an aluminum pipe having a diameter of 18 mm was coated by plating with a nickel layer having a thickness of 10 μm. The resultant surface had a surface roughness (Rz) of 4 μm. The work function of this development roller was determined and was found to be 4.58 eV.

Production of Regulation Blade

A conductive urethane chip having a thickness of 1.5 mm was bonded with a conductive adhesive to a stainless-steel sheet having a thickness of 80 μm. The urethane part in the resultant regulation blade had a work function of 5 eV.

Production Example for Intermediate Transfer Belt (1A)

A homogeneous dispersion consisting of 30 parts by weight of a vinyl chloride/vinyl acetate copolymer, 10 parts by weight of conductive carbon black, and 70 parts by weight of methyl alcohol was applied to a 130 μm-thick poly(ethylene terephthalate) resin film coated with vapor-deposited aluminum, by the roll coating method in such an amount as to give an intermediate conductive layer having a thickness of 20 μm. The dispersion applied was dried. Subsequently, a coating fluid prepared by mixing and dispersing 55 parts by weight of a nonionic aqueous urethane resin (solid content, 62%), 11.6 parts by weight of a polytetrafluoroethylene resin emulsion (solid content, 60%), 25 parts by weight of conductive tin oxide, 34 parts by weight of fine polytetrafluoroethylene particles (maximum particle diameter, ≦0.3 μm), 5 parts by weight of a polyethylene emulsion (solid content, 35%), and 20 parts by weight of ion-exchanged water was applied on the intermediate conductive layer in the same manner by the roll coating method in such an amount as to result in a thickness of 10 μm, and dried.

This coated sheet was cut into a length of 540 mm. Both ends were brought into contact with each other and subjected to ultrasonic welding to thereby produce a transfer belt. This transfer belt had a volume resistivity of $2.5\times10^{10}$ Ω·cm. It had a work function of 5.37 eV and a normalized photoelectron yield of 6.90.

Production Example for Intermediate Transfer Belt (2A)

Eighty-five parts by weight of poly(butylene terephthalate) was preliminarily mixed with 15 parts by weight of a polycarbonate and 15 parts by weight of acetylene black in a nitrogen atmosphere with a mixer. The mixture obtained was subsequently kneaded with a twin-screw extruder in a nitrogen atmosphere to obtain pellets.

Using a single-screw extruder having a circular die, the pellets obtained were extruded at 260° C. into a tubular film having an outer diameter of 170 mm and a thickness of 160 μm. Subsequently, the melt tube extruded was regulated so as to have a given inner diameter with a cooling inside mandrel supported on the same axis as the circular die. The melt tube was thus cooled and solidified to produce a seamless tube.

The tube was cut into a given size to obtain a seamless belt having an outer diameter of 172 mm, width of 342 mm, and thickness of 150 μm. This intermediate transfer belt had a volume resistivity of $3.2\times10^{8}$ Ω·cm. It had a work function of 5.19 eV and a normalized photoelectron yield of 10.88.

Production Example for Comparative Intermediate Transfer Belt (3A)

A transfer belt was produced in the same manner as for the intermediate transfer belt (1), except that 5 parts by weight of conductive titanium oxide and 25 parts by weight of conductive tin oxide were used in the layer overlying the intermediate conductive layer. This transfer belt had a volume resistivity of $8.8\times10^9$ Ω·cm, work function of 5.69 eV, and normalized photoelectron yield of 7.39.

Examples 1A to 4A and Comparative Examples 1A to 4A

An intermediate transfer medium type four-cycle color printer having the constitution shown in FIG. 4 was used which employed the organic photoreceptor (OPC1A) and the development rollers and regulation blades described above. Development cartridges respectively containing toners 1 to 4 described above were mounted on the printer in combination with the transfer belt (1A) described above. An image formation test was conducted in which images were formed through contact one-component development.

Conditions for image formation were as follows. The organic photoreceptor was operated at a peripheral speed of 180 mm/s, and the peripheral speed of each development roller was regulated to 1.6 times the peripheral speed of the organic photoreceptor. The peripheral speed of the transfer belt serving as an intermediate transfer medium was regulated so as to be higher by 3% than that of the organic photoreceptor. The peripheral-speed difference was set at 3% because differences larger than 3% may result in transferred images with toner scattering. Furthermore, by regulating the toner regulation blade, the amount of the toner being conveyed on each development roller was regulated to 0.4 mg/cm$^2$.

The conditions for image formation included a dark potential of the photoreceptor of −600 V, a light potential thereof of −80 V, and a development bias of −200 V. The development rollers and the feed rollers were made to have the same potential. A contact-voltage power source was used for the first-transfer part, and the transfer voltage in this part was +500 V.

A character manuscript corresponding to a 5% manuscript for each color and the N-2A "cafeteria" image, which is standard image data in accordance with JIS X 9201-1995, were used to conduct continuous printing of 10,000 sheets and 5,000 sheets, respectively, on the color printer shown in FIG. 4. The printed images obtained were evaluated for initial quality by visually examining color shifting. In the prints of the 5% color manuscript, prints obtained after the 10,000 sheets were examined for color shifting. In the case of the prints obtained from N-2A, which is a natural image, the whole prints were examined for a change in color shifting.

At the time when distinct color shifting due to color mixing occurred, the toners in the developing devices were judged to have ended their life. Namely, in case where the efficiency of transfer is low or the amount of a reversely transferred toner is large, toner inclusion into the toner of a different color in the next developing device occurs and this results in color mixing and makes it difficult to reproduce the pure color. Color mixing thus causes color shifting or the like.

The results of the evaluation are shown in Table 1A with respect to each of the case in which the printer had the cleaning part (170) as shown in FIG. 4 and the case in which the printer did not have the cleaning part (170). In Comparative Examples, the transfer belt (3A) described above was used to conduct continuous printing in the same manner as described above, without using the cleaning part (170). The results obtained are shown in Table 1A.

The toners used were cyan toner 1A (abbreviation, C1; work function, 5.54 eV), magenta toner 2A (abbreviation, M2; work function, 5.63 eV), yellow toner 3A (abbreviation, Y3; work function, 5.58 eV), and black toner 4A (abbreviation, BK4; work function, 5.48 eV).

Each time when the sequence of development/transfer was changed, the sequence of image date processing was changed to conduct continuous printing.

TABLE 1A

| Example Nos. (sequence of development/transfer) | Transfer belt Work function (eV) | Number of sheets printed before color shifting by color mixing was visually observed: With cleaning part, 5% manuscript | With cleaning part, N2A manuscript | Without cleaning part, 5% manuscript | Without cleaning part, N2A manuscript |
|---|---|---|---|---|---|
| Example 1A (M2-Y3-C1-BK4) | 5.37 | 10000 | 5000 | 10000 | 4800 |
| Comp. Example 1A (M2-Y3-C1-BK4) | 5.69 | 10000 | 5000 | 6200 | 2500 |
| Example 2A (M2-C1-Y3-BK4) | 5.37 | 10000 | 5000 | 7200 | 3000 |
| Comp. Example 2A (M2-C1-Y3-BK4) | 5.69 | 10000 | 5000 | 5900 | 2300 |
| Example 3A (Y3-C1-M2-BK4) | 5.37 | 10000 | 5000 | 7200 | 3000 |
| Comp. Example 3A (Y3-C1-M2-BK4) | 5.69 | 10000 | 5000 | 5900 | 2200 |
| Example 4A (BK4-Y3-C1-M2) | 5.37 | 10000 | 5000 | 7100 | 2850 |
| Comp. Example 4A (BK4-Y3-C1-M2) | 5.69 | 10000 | 5000 | 5800 | 2000 |

The results given in Table 1A show that when an intermediate transfer belt whose surface has a work function smaller than the work functions of the toners is used as in the first invention, a higher transfer efficiency is obtained as compared with the reverse case in which a transfer belt having a larger work function than the toners is used. It was presumed from these results that the toners present on each intermediate transfer belt had changed in electrification. The toners on the development roller and the toners on each intermediate transfer belt were hence actually examined for electrification with a charge amount meter (Analyzer E-SPART, manufactured by Hosokawa Micron Corp.). The results thereof are shown in Table 2A.

TABLE 2A

| Transfer belt | Toner | Average charge amount (μC/g) On development roller | Average charge amount (μC/g) On transfer belt | Positive-toner percent by number On development roller | Positive-toner percent by number On transfer belt | Relationship in work function $\phi_t$: toner $\phi_{TM}$: belt |
|---|---|---|---|---|---|---|
| Transfer belt (1A) | Cyan toner 1A | −13.53 | −11.63 | 2.7% | 1.6% | $\phi_t > \phi_{TM}$ |
| | Magenta toner 2A | −16.15 | −14.48 | 1.1% | 0.7% | |
| | Yellow toner 3A | −14.27 | −13.39 | 2.2% | 1.0% | |
| | Black toner 4A | −13.21 | −11.21 | 3.0% | 2.5% | |
| Comparative transfer belt (3A) | Cyan toner 1A | −13.53 | −13.53 | 2.7% | 5.1% | $\phi_{TM} > \phi_t$ |
| | Magenta toner 2A | −16.15 | −13.53 | 1.1% | 3.9% | |
| | Yellow toner 3A | −14.27 | −13.53 | 2.2% | 4.3% | |
| | Black toner 4A | −13.21 | −13.53 | 3.0% | 6.6% | |

The results in Table 2A show the following. In the image-forming apparatus according to the first invention, in which the work functions of the toners were larger than that of the intermediate transfer belt, the amount of each positively charged toner, in terms of percent by number, on the transfer belt tended to be smaller than on the development roller. Conversely, in the apparatus of the Comparative Examples, in which the work function of the surface of the intermediate transfer belt was larger than those of the toners, the amount of each positively charged toner on the transfer belt tended to be larger. This indicates an increase in the amount of reversely transferred toners, and means that the degree of color mixing increases if no cleaning member is disposed.

In the color printer shown in FIG. 4, a direct-current constant-voltage power source is used for the first-transfer part and a constant-current power source is used for the second-transfer part. The use of a direct-current constant-voltage power source is advantageous in the prevention of toner scattering, while the use of a constant-current direct-current power source for the second-transfer part is advantageous because stable transfer characteristics can be obtained regardless of the kind of paper.

Examples 5A to 8A

An intermediate transfer medium type tandem color printer having the constitution shown in FIG. 5 was used which employed the organic photoreceptor (OPC2A) and the development rollers and regulation blades. Development cartridges respectively containing toners 1A to 4A were mounted on the printer in combination with the intermediate transfer belt (2A). A continuous printing test was conducted through non-contact one-component development.

Prior to image formation, standard conditions for image formation were set so as to include the following. The dark potential of the photoreceptor was −600 V, and the light potential thereof was −80 V. The gap between each development roller and the corresponding photoreceptor was regulated to 210 μm with gap rollers. An alternate current having a frequency of 2.5 kHz and a P—P voltage of 1,400 V was superimposed on a direct-current development bias of −200 V. The development rollers and the feed rollers were made to have the same potential.

Printing was conducted while regulating the feed amount of each toner so that the amount of the toner deposited on the photoreceptor in solid printing was 0.53 mg/cm$^2$ at the most.

By regulating the toner regulation blade, the amount of the toner being conveyed on each development roller was regulated to 0.4 to 0.43 mg/cm$^2$.

The tandem color printer shown in FIG. 5 is a so-called cleaner-less printer having no cleaning member beside the photoreceptors. As in Example 1A, a character manuscript corresponding to a 5% manuscript for each color and the N-2A "cafeteria" image, which is standard image data in accordance with JIS X 9201-1995, were used to conduct continuous printing of 10,000 sheets and 5,000 sheets, respectively. The results obtained are shown in Table 3A. In the tandem color printer shown in FIG. 5, a direct-current constant-voltage power source was used for each first-transfer part and a direct-current constant-current power source was used for the second-transfer part.

Under standard conditions, the toners were used for development/transfer in descending order of work function. Each time when this sequence was changed, the sequence of image data processing was changed to conduct printing.

In Table 3A is shown the number of sheets thought to be printed before the initial print quality deteriorated and distinct color shifting occurred.

An intermediate transfer belt having a large work function produced in the same manner as for the intermediate transfer belt (3A) was mounted, and this printer was used to conduct continuous printing in the same manner. Image evaluation was conducted and the number of sheets printed before the occurrence of color shifting is also shown in Table 3A.

TABLE 3A

| Example Nos. (sequence of development/transfer) | Transfer belt Work function (eV) | Number of sheets printed before color shifting by color mixing was visually observed 5% manuscript | N2A manuscript |
|---|---|---|---|
| Example 5A (M2-Y3-C1-BK4) | 5.19 | 10000 | 4800 |
| Comparative Example 5A (M2-Y3-C1-BK4) | 5.69 | 6900 | 2800 |
| Example 6A (C1-M2-Y3-BK4) | 5.19 | 7300 | 3000 |
| Comparative Example 6A (C1-M2-Y3-BK4) | 5.69 | 6100 | 2300 |
| Example 7A (Y3-C1-M2-BK4) | 5.19 | 7100 | 3000 |

TABLE 3A-continued

| Example Nos. | Transfer belt | Number of sheets printed before color shifting by color mixing was visually observed | |
|---|---|---|---|
| (sequence of development/transfer) | Work function (eV) | 5% manuscript | N2A manuscript |
| Comparative Example 7A (Y3-C1-M2-BK4) | 5.69 | 5800 | 2300 |
| Example 8A (BK4-C1-M2-Y3) | 5.19 | 7000 | 2800 |
| Comparative Example 8A (BK4-C1-M2-Y3) | 5.69 | 5900 | 2000 |

Table 3A shows the following. In the image-forming apparatus according to the first invention, in which the intermediate transfer belt had a smaller work function than the toners, toner color mixing was reduced. It was found that this apparatus was hence capable of yielding a larger number of prints than the apparatus employing an intermediate transfer belt having a large work function when the same toner cartridges were used.

On the other hand, when the amount of each toner to be deposited for development on the organic photoreceptor in solid printing is regulated to about 0.6 mg/cm$^2$ at the most, the transfer efficiency tends to decrease at the constant first-transfer voltage as compared with the case of using image-forming conditions in which the amount of each toner to be deposited for development is smaller. As a result, the number of sheets printed before the occurrence of color mixing was found to be 2,500 or smaller. This phenomenon was thought to be because the transfer field intensity employed was unsuitable. It could hence be judged that the amount of each toner to be deposited for development was preferably 0.55 mg/cm$^2$ or less.

The results further show that when toners having a high roundness are used in combination with an intermediate transfer belt having a smaller work function than all these toners as in the first invention, a cleaner-less image-forming apparatus can be provided.

In the first invention, the surface of the intermediate transfer medium has a work function equal to or smaller than the work function of each toner. Because of this, electrons (charges) move from the intermediate transfer belt to the toners to negatively charge the toners. Each toner is hence never charged positively although the amount of negative charges therein can increase. Consequently, reverse toner transfer is inhibited.

As a result, color mixing caused by an oppositely charged toner can be prevented in the image-forming apparatus, in which toners of different colors are superposed on the intermediate transfer medium and then transferred to a recording medium such as paper. Images having excellent quality can hence be formed. Consequently, an image-forming apparatus which does not generate waste toners can be provided.

Next, Examples of the second invention are described below.

Production Example for Toner 1B

A monomer mixture consisting of 80 parts by weight of styrene monomer, 20 parts by weight of butyl acrylate, and 5 parts by weight of acrylic acid was added to an aqueous solution mixture consisting of 105 parts by weight of water, 1 part by weight of a nonionic emulsifying agent (Emulgen 950, manufactured by Dai-ichi Kogyo Seiyaku Co., Ltd.), 1.5 parts by weight of an anionic emulsifying agent (Neogen R, manufactured by Dai-ichi Kogyo Seiyaku Co., Ltd.), and 0.55 parts by weight of potassium persulfate. Polymerization was conducted at 70° C. for 8 hours with stirring in a nitrogen stream.

After the polymerization reaction, the reaction mixture was cooled to obtain a milk-white resin emulsion having a particle-diameter of 0.25 μm. Subsequently, 200 parts by weight of the resin emulsion, 20 parts by weight of a polyethylene wax emulsion (manufactured by Sanyo Chemical Industries, Ltd.), and 7 parts by weight of Phthalocyanine Blue were dispersed in water containing 0.2 parts by weight of sodium dodecylbenzenesulfonate as a surfactant. Diethylamine was added to the dispersion to adjust the pH thereof to 5.5. Thereafter, 0.3 parts by weight of aluminum sulfate as an electrolyte was added to the dispersion with stirring, and the resultant mixture was agitated for dispersion with an agitator (TK Homomixer) at a high speed.

Thereto were further added 40 parts by weight of styrene monomer, 10 parts by weight of butyl acrylate, and 5 parts by weight of zinc salicylate together with 40 parts by weight of water. In a nitrogen stream, an aqueous hydrogen peroxide solution was added to the mixture and polymerization was conducted in the same manner for 5 hours with stirring and heating at 90° C. to grow the particles. After termination of the polymerization, the reaction mixture was heated to 95° C. and held for 5 hours while regulating the pH thereof to 5 or higher in order to increase the bonding strength of association particles. Thereafter, the particles obtained were washed with water and vacuum-dried at 45° C. for 10 hours.

The cyan toner thus obtained had an average particle diameter of 6.8 μm and a roundness of 0.98. To the toner obtained were added 1% by weight hydrophobic silica having an average primary-particle diameter of 12 nm and 0.7% by weight hydrophobic silica having an average primary-particle diameter of about 40 nm as flowability improvers. These ingredients were mixed together. Subsequently, 0.5% by weight hydrophobic titanium oxide having an average primary-particle diameter of about 20 nm and 0.4% by weight positively electrifiable hydrophobic silica obtained by treating the surface of hydrophobic silica having an average primary-particle diameter of about 30 nm with aminosilane were added to the mixture. These ingredients were mixed together. Thus, toner 1B was obtained. The toner obtained was examined for work function with a surface analyzer (Type AC-2, manufactured by Riken Keiki Co., Ltd.) at a quantity of irradiation light of 500 nW. As a result, the work function thereof was found to be 5.54 eV.

In this Example, roundness was determined through a measurement with a flow type particle image analyzer (FPIA 2100, manufactured by Sysmex Corp.) and shown in terms of the following expression (1):

$$R=L_0/L_1 \quad (1)$$

wherein $L_1$ is the peripheral length (μm) of a projected image of a toner particle being examined; and $L_0$ is the peripheral length (μm) of the complete circle equal in area to the projected image of the toner particle being examined.

Average particle diameter is shown in terms of volume distribution D50 determined with an electric-resistance particle size distribution analyzer (Multisizer III, manufactured by Beckman-Coulter Inc.).

Although the toner obtained had a work function of 5.54 eV, the value of work function in this Example was obtained through examination with a surface analyzer (Type AC-2, manufactured by Riken Keiki Co., Ltd.) at a quantity of irradiation light of 500 nW.

Production Example for Toner 2B

The same procedure as for Toner 1B was conducted, except that quinacridone was used in place of Phthalocyanine Blue as a pigment and that the heating for enhancing association for secondary-particle formation and bonding strength for film formation was conducted while keeping the temperature at 90° C. Thus, toner 2B was produced. This magenta toner had a roundness of 0.972 and a work function of 5.63 eV. This toner had a number-average particle diameter of 6.9 μm.

Production Example for Toners 3B and 4B

Polymerization was conducted in the same manner as for toner 2B, except that Pigment Yellow 180 or carbon black was used in place of the pigment used for toner 2B. Flowability improvers were added to the resultant toners in the same manner as for toner 2B. Thus, yellow toner 3B having a roundness of 0.972, work function of 5.58 eV, and average particle diameter of 7.0 μm, and black toner 4B having a roundness of 0.973, work function of 5.48 eV, and average particle diameter of 6.9 μm were produced.

Production Example for Toner 5B

A hundred parts by weight of a 50:50 by weight mixture of an aromatic dicarboxylic acid/bisphenol A alkylene ether polycondensation polyester with a product of partial crosslinking of the polycondensation polyester with a compound of a polyvalent metal (the mixture being a product of Sanyo Chemical Industries, Ltd.) was evenly mixed with 5 parts by weight of Pigment Blue 15:1 as a cyan pigment, 1 part by weight of polypropylene having a melting point of 152° C. and a weight-average molecular weight (Mw) of 4,000 as a release agent, and 4 parts by weight of a salicylic acid metal complex (E-81, manufactured by Orient Chemical Industries Ltd.) as a charge control agent by means of a Henschel mixer. The resultant mixture was kneaded with a twin-screw extruder having an internal temperature of 130° C. and then cooled.

The mixture cooled was crushed into particles of 2 mm square or smaller and then pulverized with a jet mill. The resultant particles were classified with a rotary classifier to obtain a toner having an average particle diameter of 6.2 μm and a roundness of 0.905 through classification. To the toner obtained through classification was added 0.2% by weight hydrophobic silica (average primary-particle diameter, 7 nm; specific surface area, 250 $m^2/g$) to conduct a surface treatment. Thereafter, a hot-air rounding apparatus (Type SFS-3, manufactured by Nippon Pneumatic Mfg. Co., Ltd.) was used to conduct a partial rounding treatment at a heat treatment temperature of 200° C. The particles thus treated were classified again in the same manner to obtain toner particles having an average particle diameter of 6.3 μm and a roundness of 0.940 as base particles for cyan toner 5B. Flowability improves were added to these base toner particles in the same manner as for toner 1B to produce toner 5B. The work function of the toner obtained was determined in the same manner and was found to be 5.48 eV.

Production Example for Toners 6B, 7B and 8B

Pulverization, classification, heat treatment, re-classification, and surface treatment were conducted in the same manner as for toner 5B, except that Naphthol AS-6B was used in place of the pigment used for toner 5B. Thus, magenta toner 6B was obtained which had an average particle diameter of 6.5 μm and a roundness of 0.942.

The work function of this toner 6B was determined and was found to be 5.53 eV. Toner 7B employing Pigment Yellow 93 as a yellow toner and toner 8B employing carbon black as a black toner were produced in the same manner.

The toners thus obtained had almost the same average particle diameter and roundness as toner 6B. The work functions thereof were 5.57 eV (yellow) and 5.63 eV (black).

Production Example for Organic Photoreceptor (OPC1B)

A coating fluid prepared by dissolving or dispersing 6 parts by weight of an alcohol-soluble nylon (CM8000, manufactured by Toray Industries, Inc.) and 4 parts by weight of-aminosilane-treated fine titanium oxide particles in 100 parts by weight of methanol was applied by the ring coating method on an aluminum pipe having a diameter of 85.5 mm as a base for photoreceptor drum formation. The coating fluid applied was dried at a temperature of 100° C. for 40 minutes to form an undercoat layer having a thickness of from 1.5 to 2 μm.

A mixture consisting of 1 part by weight of oxytitanylphthalocyanine as a charge-generating pigment, 1 part by weight of a butyral resin (BX-1, manufactured by Sekisui Chemical Co., Ltd.), and 100 parts by weight of dichloroethane was treated for 8 hours with a sand mill employing glass beads having a diameter of 1 mm to disperse the pigment.

The pigment dispersion obtained was applied by the ring coating method on the base prepared above. The dispersion applied was dried at 80° C. for 20 minutes to form a charge-generating layer having a thickness of 0.3 μm.

In 400 parts by weight of toluene were dissolved 40 parts by weight of the styryl compound of the following structural formula (1) as a charge-transporting substance and 60 parts by weight of a polycarbonate resin (Panlite TS, manufactured by Teijin Chemicals Ltd.). This solution was applied to the charge-generating layer by dip coating in a thickness of 22 μm on a dry basis, and dried to form a charge-transporting layer. Thus, an organic photoreceptor (OPC1B) having a photosensitive layer composed of two layers was produced.

Part of the organic photoreceptor obtained was cut out as a sample piece and examined for work function with a commercial surface analyzer (Type AC-2, manufactured by Riken Keiki Co., Ltd.) at a quantity of irradiation light of 500 nW. As a result, the work function thereof was found to be 5.47 eV.

Structural formula (1)

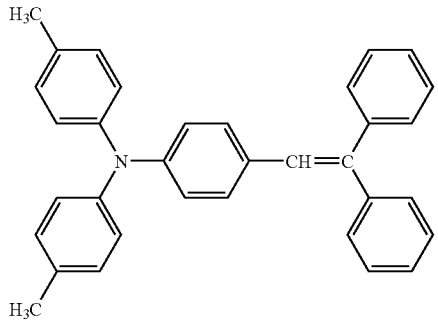

Production Example for Organic Photoreceptor (OPC2B)

An organic photoreceptor (OPC2B) was produced in the same manner as for the organic photoreceptor (OPC1B), except that an aluminum pipe having a diameter of 30 mm was used as a conductive base and that the charge-generating pigment and the charge-transporting substance were replaced by titanylphthalocyanine and the distyryl compound of the following structural formula (2), respectively.

The work function of this organic photoreceptor was determined in the same manner and was found to be 5.50 eV.

Structural formula (2)

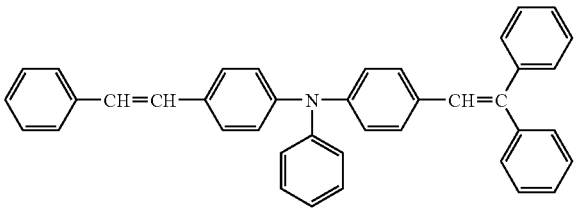

Production of Development Roller

The surface of an aluminum pipe having a diameter of 18 mm was coated by plating with a nickel layer having a thickness of 10 μm. The resultant surface had a surface roughness (Rz) of 4 μm. The work function of this development roller was determined and was found to be 4.58 eV.

Production of Regulation Blade

A conductive urethane chip having a thickness of 1.5 mm was bonded with a conductive adhesive to a stainless-steel sheet having a thickness of 80 μm. The urethane part in the resultant regulation blade had a work function of about 5 eV.

Production Example for Intermediate Transfer Medium

Although either a transfer belt or a transfer drum can be used as an intermediate transfer medium, transfer belts were used in the following Examples.

Various ingredients for intermediate transfer belts were mixed together according to each of the formulations shown in Table 1B. The unit of the ingredient amounts in the formulations is parts by weight.

First, a kneading machine was regulated so as to have a preset temperature of 180° C. Masterbatch A, which contained an ion-conductive polymer, was kneaded together with masterbatch B, which contained a polymer having low moisture permeability. During this kneading, compounding ingredient C, which functioned to vulcanize only the ion-conductive polymer, was added to vulcanize the ion-conductive polymer first.

Thereafter, compounding ingredient D for the next step was added and the resultant mixture was kneaded at 100° C. The mixture thus kneaded was taken out of the kneading machine and extruded at 90° C. with a single-screw extruder having a circular die into a tube having an inner diameter of 170 mm and a thickness of 2 mm. Subsequently, the extrudate tube was regulated so as to have a given inner diameter with a cooling inside mandrel supported on the same axis as the circular die. The extrudate was thus cooled and solidified to produce a seamless tube. This tube was cut into a given size to obtain a seamless belt having an outer diameter of 172 mm, width of 383 mm, and thickness of 150 μm. Furthermore, this belt was polished so as to result in a rubber thickness of 0.50±0.05 mm in preparation for use as a transfer belt. Found values of volume resistivity and work function for the transfer belt obtained are shown in Table 2B.

TABLE 1B

| Kneading material | Composition of kneading material | Material | Transfer belt 1B (parts by weight) | Transfer belt 2B (parts by weight) | Compara. belt 1B (parts by weight) | Compara. belt 2B (parts by weight) |
|---|---|---|---|---|---|---|
| A | Ionconductive polymer | Allyl glycidyl ether/ethylene oxide/epichlorohydrin copolymer | 80 | 80 | 80 | 80 |
| | Ionicconductivity-imparting agent 1 | Lithium perchlorate | 1.0 | — | 4.0 | 5.0 |
| | Ionicconductivity-imparting agent 2 | Sodium perchlorate | 1 | 5.0 | — | — |
| | Compatibilizing agent | Chlorinated polyethylene | 12.0 | 10.0 | 3.0 | 10.0 |
| | Acid acceptor | Aluminum chloride/magnesium carbonate hydrate | 8.0 | 8.0 | 8.0 | 8.0 |
| B | Polymer with low moisture permeability | Ethylene/propylene/diene copolymer | 20 | 20 | 20 | 20 |
| | Compatibilizing agent | Chlorinated polyethylene | 3.0 | 3.0 | 2.0 | 3.0 |
| C | Vulcanization accelerator 1 | Tetramethyl thiuram monosulfide | 0.4 | 0.4 | 0.4 | 0.4 |
| | Processing aid | Stearic acid | 1.0 | 1.0 | 1.0 | 1.0 |
| | Vulcanizing agent | 2,4,6-Trimercapto-1,3,5-triazine | 0.7 | 0.7 | 0.7 | 0.7 |
| D | Polymeric anti-static agent | Polyether ester amide | 15 | 10 | 5.0 | 3.5 |
| | Processing aid | Stearic acid | 1.0 | 1.0 | 1.0 | 1.0 |
| | Extender pigment | Zinc white | 1.0 | 1.0 | 1.0 | 1.0 |
| | Vulcanization accelerator 2 | Zinc dibutyldithio carbamate | 0.2 | 0.2 | 0.2 | 0.2 |
| | Vulcanizing agent | Powdered sulfur | 0.2 | 0.2 | 0.2 | 0.2 |

Materials shown in Table 1B are as follows.

Allyl glycidyl ether/ethylene oxide/epichlorohydrin copolymer:
Epichlomer CG102, manufactured by Daiso.

Lithium perchlorate:
manufactured by Kanto Chemical.

Sodium perchlorate:
manufactured by Kanto Chemical.

Chlorinated polyethylene:
Daisolac RA 140, manufactured by Daiso.

Aluminum chloride/magnesium carbonate hydrate:
DHT-4A-2, manufactured by Kyowa Chemical.

Ethylene/propylene/diene copolymer:
Esprene 553, manufactured by Sumitomo Chemical.

Tetramethylthiuram monosulfide:
Nocceler TS, manufactured by Ouchi-Shinko Chemical Industrial.

2,4,6-Trimercapto-1,3,5-triazine:
OF-100, manufactured by Daiso.

Polymeric antistatic agent:
Pelestat, manufactured by Sanyo Chemical Industries.

Zinc white:
Zinc White #1, manufactured by Toho Zinc.

Zinc dibutyldithiocarbamate:
Nocceler BZ, manufactured by Ouchi-Shinko Chemical Industries.

Powdered sulfur:
manufactured by Tsurumi Kagaku.

TABLE 2B

| Evaluation items | Transfer belt 1B | Transfer belt 2B | Comp. transfer belt 1B | Comp. transfer belt 2B |
|---|---|---|---|---|
| Volume resistivity (Ω · cm) | $9.3 \times 10^9$ | $5.1 \times 10^9$ | $3.6 \times 10^9$ | $3.3 \times 10^9$ |
| Work function (eV) | 5.44 | 5.22 | 5.73 | 5.63 |
| Normalized photoelectron yield | 9.4 | 11.9 | 8.9 | 8.2 |

Example 1B

An intermediate transfer medium type four-cycle color printer having the constitution shown in FIG. 4 was used which employed the organic photoreceptor (OPC1B) and the development roller and the regulation blade. Toner 1B (5.54 eV) produced was used in combination with transfer belt 1B or transfer belt 2B produced. An image formation test was conducted through non-contact one-component development.

In image formation, the organic photoreceptor was operated at a peripheral speed of 180 mm/s, and the peripheral speed of the development roller was regulated to 1.6 times the peripheral speed of the organic photoreceptor. The peripheral speed of the transfer belt serving as an intermediate transfer medium was regulated so as to be higher by 3% than that of the organic photoreceptor.

Peripheral-speed differences larger than 3% resulted in transferred images with toner scattering. The upper limit thereof was hence regulated to 3%.

By regulating the toner regulation blade, the amount of the toner being conveyed on the development roller was regulated to 0.4 mg/cm$^2$.

Conditions for image formation were as follows. The gap between the development roller and the photoreceptor was regulated to 210 μm with gap rollers. An alternate current having a frequency of 2.5 kHz and a P—P voltage of 1,400 V was superimposed on a direct-current development bias voltage of −200 V. The development roller and the feed roller were made to have the same potential. A constant-voltage power source and a constant-current power source were used for the first-transfer part and the second-transfer part, respectively.

A 5% manuscript was used to print two sheets. Thereafter, the developing device was demounted. The development roller (DR) was taken out, and the intermediate transfer belt (TB) was demounted. The toner attached to the development roller and the toner attached to the intermediate transfer belt were examined for electrification with a particle size/charge amount meter (Analyzer E-SPART, manufactured by Hosokawa Micron Corp.). The results thereof are shown in Table 3B.

TABLE 3B

| Transfer belt | Work function (eV) | Charge amount (μC/g) on DR | Charge amount (μC/g) on TB | Amount of positively charged toner (% by number) on DR | Amount of positively charged toner (% by number) on TB |
|---|---|---|---|---|---|
| Transfer belt 1B | 5.44 | −13.84 | −12.91 | 4.7 | 5.3 |
| Transfer belt 2B | 5.22 | −13.84 | −13.35 | 4.7 | 4.9 |
| Comparative belt 1B | 5.73 | −13.84 | −8.83 | 4.7 | 25.6 |
| Comparative belt 2B | 5.63 | −13.84 | −9.02 | 4.7 | 20.3 |

Furthermore, solid printing was conducted. The image after fixing was examined for density (reflection density). A pressure-sensitive adhesive tape (mending tape manufactured by Sumitomo 3M) was applied to the nonimage area of the photoreceptor surface to remove the attached toner therefrom. This tape was applied to white paper, and the reflection density thereof was measured. From this found value was subtracted the reflection density of the tape itself. Thus, the fog density was determined by the tape transfer method.

The density of the so-called reversely transferred toner, which was the toner returned to the photoreceptor after the solid printing, was also determined by the tape transfer method in the same manner. The results obtained are shown in Table 4B.

TABLE 4B

| Transfer belt | Work function (eV) | Solid OD value | Fog OD value | Reversely transferred toner OD value |
|---|---|---|---|---|
| Transfer belt 1B | 5.44 | 1.40 | 0.01 | 0.01 |
| Transfer belt 2B | 5.22 | 1.41 | 0.02 | 0.02 |
| Comparative belt 1B | 5.73 | 1.43 | 0.20 | 0.16 |
| Comparative belt 2B | 5.63 | 1.45 | 0.19 | 0.13 |

Comparative Example 1B

Image formation was conducted in the same manner as in Example 1B, except that comparative belt 1B and comparative belt 2B, which had different work functions, were used. These apparatus were evaluated in the same manner as in Example 1B.

Table 4B shows the following. In each of comparative belts 1B and 2B, which have a larger work function than the toner, the transfer of the toner from the development roller to the intermediate transfer belt resulted in a decrease in toner charge amount and simultaneously in an increase in the amount of the positively charged toner. As a result, fogging was enhanced and the amount of the reversely transferred toner was increased. The reasons for this may be that since a positive voltage, which was opposite to the polarity of the toner, was applied at the time of transfer, the movement of electrons (charges) of the toner to the intermediate transfer medium was facilitated and this resulted in the decrease in charge amount and the generation of an oppositely charged toner.

Example 2B

An image formation test was conducted in the same manner as in Example 1B, except that toner 5B (5.48 eV) was used in place of toner 1B. The results obtained are shown in Tables 5B and 6B.

Comparative Example 2B

An image formation test was conducted in the same manner as in Example 2B, except that comparative belt 1B and comparative belt 2B were used in place of transfer belt 1B. The results obtained are shown in Tables 5B and 6B.

TABLE 5B

| Transfer belt | Work function (eV) | Charge amount (μC/g) on DR | Charge amount (μC/g) on TB | Amount of positively charged toner (% by number) on DR | Amount of positively charged toner (% by number) on TB |
|---|---|---|---|---|---|
| Transfer belt 1B | 5.44 | −15.33 | −14.99 | 5.1 | 7.1 |
| Transfer belt 2B | 5.22 | −15.33 | −15.22 | 5.1 | 6.8 |
| Comparative belt 1B | 5.73 | −15.33 | −9.99 | 5.1 | 26.9 |
| Comparative belt 2B | 5.63 | −15.33 | −10.31 | 5.1 | 23.2 |

TABLE 6B

| Transfer belt | Work function (eV) | Solid OD value | Fog OD value | Reversely transferred toner OD value |
|---|---|---|---|---|
| Transfer belt 1B | 5.44 | 1.36 | 0.02 | 0.02 |
| Transfer belt 2B | 5.22 | 1.37 | 0.03 | 0.03 |
| Comparative belt 1B | 5.73 | 1.40 | 0.23 | 0.19 |
| Comparative belt 2B | 5.63 | 1.41 | 0.20 | 0.18 |

The results given above show that in Comparative Example 2B, which employed intermediate transfer belts having a larger work function than the toner, the transfer of the toner from the development roller to each intermediate transfer belt was thought to result in a decrease in toner charge amount and simultaneously in an increase in the amount of the positively charged toner.

Examples 3B and 4B

Using the image-forming apparatus shown in FIG. 4 and using transfer belt 1B as an intermediate transfer medium and toners 1B to 4B, an image formation test was conducted in the same manner as in Example 1B.

Conditions for this image formation were as follows. The toner regulation blades were regulated so that the amount of the toner being conveyed on each development roller was in the range of from 0.38 to 0.40 mg/cm$^2$. The toners used were cyan toner 1B (abbreviation, C1; work function, 5.54 eV), magenta toner 2B (abbreviation, M2; work function, 5.63 eV), yellow toner 3B (abbreviation, Y3; work function, 5.58 eV), and black toner 4B (abbreviation, BK4; work function, 5.48 eV). These toners were disposed in the developing units of the image-forming apparatus so that the toners were arranged in descending order of work function from the upstream side of the developing devices. Using a character manuscript corresponding to a 5% manuscript for each color, continuous image formation was conducted on 10,000 sheets.

After the 10,000-sheet continuous image formation, the toners were recovered from the photoreceptor and the intermediate transfer medium by cleaning and totaled. The results (unit: g) obtained are shown in Table 7B.

Comparative Examples 3B to 5B

An image formation test was conducted in the same manner as in Example 3B, except that the sequence of toner deposition for development was changed as shown in Table 7B. The results obtained are shown in Table 7B. Each time when the sequence of development/transfer was changed, the sequence of image data processing was changed to conduct continuous printing.

Comparative Example 6B

An image formation test was conducted in the same manner as in Example 3B, except that comparative belt 1B was used as an intermediate transfer belt in place of transfer belt 1B in Example 3B. The results obtained are shown in Table 7B.

TABLE 7B

| Example Nos. (sequence of development/transfer) | Transfer belt | Recovered toner amount (g) |
|---|---|---|
| Example 3B (M2-Y3-C1) | Transfer belt 1B | 30 |
| Example 4B (Y3-C1-BK4) | Transfer belt 1B | 31 |
| Comparative Example 3B (M2-C1-Y3) | Transfer belt 1B | 45 |
| Comparative Example 4B (Y3-C1-M2) | Transfer belt 1B | 50 |
| Comparative Example 5B (C1-M2-Y3) | Transfer belt 1B | 51 |
| Comparative Example 6B (M2-Y3-C1) | Comparative belt 1B | 65 |

The results given above show that the apparatus in which the amount of the toners recovered by cleaning was smallest was the one which employed the intermediate transfer belt containing an ion-conductive substance and having a smaller work function than the toners and in which the toners were deposited for development in descending order of work function. It was thus found that this constitution is effective in minimizing the amount of the toners to be recovered by cleaning.

The results further show that in the apparatus employing a transfer belt containing an ion-conductive substance and having a larger work function than the toners, deposition of the toners for development in descending order of work function did not result in a reduced amount of the toners recovered by cleaning and resulted in an increase in the amount thereof. In the case where an intermediate transfer belt containing an ion-conductive substance is employed, an even higher transfer efficiency can be obtained by regulating the intermediate transfer belt so as to have a smaller work function than the toners and by depositing the toners for development in descending order of work function from the upstream side. As a result, the amount of the toners to be recovered by cleaning can be reduced. This is advantageous in reducing the apparatus size.

Examples 5B and 6B

Toners 5B to 8B were charged into the developing parts for respective colors of the tandem full-color printer shown in FIG. 8, which had process cartridges each including a united photoreceptor. An image formation test was conducted through non-contact one-component development.

The toners used were cyan toner 5B (work function, 5.48 eV), magenta toner 6B (work function, 5.53 eV), yellow toner 7B (work function, 5.57 eV), and black toner 8B (work function, 5.63 eV). The process cartridges were mounted so that the toners were deposited for development and transferred in descending order of work function, i.e., in the order of black toner 8B (K8), yellow toner 7B (Y7), magenta toner 6B (M6), and cyan toner 5B (C5).

As each organic photoreceptor was used OPC2B. The constitutions of the development rollers and the regulation blades were the same as in Example 1B. As the intermediate transfer belt was used transfer belt 1B. The amount of the toner being conveyed on each development roller was regulated so as to be in the range of from 0.4 to 0.43 mg/cm$^2$ by regulating the regulation blade.

In image formation, a voltage was applied under such conditions that an alternate current having a frequency of 2.5 kHz and a P—P voltage of 1,400 V was superimposed on a direct-current development bias of −200 V. The first-transfer parts were controlled with application of a constant voltage, while the second-transfer part was controlled with application of a constant current. Using a character manuscript corresponding to a 5% manuscript for each color, continuous image formation was conducted on 10,000 sheets. Thereafter, the toners remaining on the four photoreceptors and on the intermediate transfer belt were recovered by cleaning and totaled. The results (unit: g) obtained are shown in Table 8B.

Comparative Examples 7B and 8B

An image formation test was conducted in the same manner as in Example 5B, except that the sequence of toner deposition for development was changed as shown in Table 8B. The results obtained are shown in Table 8B. Each time when the sequence of image transfer was changed, the sequence of image data processing was changed to conduct continuous printing.

TABLE 8B

| Example Nos. (sequence of development/transfer) | Transfer belt | Recovered toner amount (g) |
|---|---|---|
| Example 5B (K8-Y7-M6) | Transfer belt 1B | 46 |

TABLE 8B-continued

| Example Nos. (sequence of development/transfer) | Transfer belt | Recovered toner amount (g) |
|---|---|---|
| Example 6B (Y7-M6-C5) | Transfer belt 1B | 47 |
| Comparative Example 7B (K8-Y7-M6) | Comparative belt 2B | 81 |
| Comparative Example 8B (Y7-M6-C5) | Comparative belt 2B | 80 |

The results in these Examples and Comparative Examples show the following. Use of the intermediate transfer belt containing an ion-conductive substance and having a larger work function than the toners resulted in an increased amount of the toners recovered by cleaning and in a reduced transfer efficiency even when the sequence of development/transfer was taken into account. In case where the total amount of the toners to be recovered by cleaning can be reduced, the size of the waste toner box can be reduced and, hence, the full-color printer can be made smaller.

Furthermore, continuous printing was conducted according to Comparative Examples 7B and 8B without taking account of work function in determining the sequence of toner deposition for development, i.e., under such conditions that the toners were deposited in the orders of (M6-K8-Y7) and (C5-Y7-M6). As a result, the amount of the toners recovered by cleaning was 95 g.

In the image-forming apparatus of the second invention, which employs an intermediate transfer medium containing an ion-conductive substance, electrostatic latent images are successively developed with toners of different colors and the toner images are transferred to the intermediate transfer medium and then to a recording medium. In this apparatus, images are formed under such conditions as to satisfy the given relationship between the work function of the intermediate transfer medium and the work functions of the toners. Because of this, the transfer efficiency improves and the amount of toner residues remaining on the photoreceptor decreases. As a result, the amount of the toners not used for image formation decreases and the amount of the toners to be recovered by cleaning decreases accordingly. Consequently, an image-forming apparatus in which the cleaning members have a prolonged life and the tank for recovered toners is small can be provided.

While the present invention has been described in detail and with reference to specific embodiments thereof, it will be apparent to one skilled in the art that various changes and modifications can be made therein without departing from the spirit and scope thereof.

The present application is based on Japanese patent application Nos. 2003-016521 and 2003-022705, the contents thereof being incorporated herein by reference.

What is claimed is:

1. An image-forming apparatus comprising:

at least one latent image holding member on which an electrostatic latent image is to be formed;

developing devices having toners of different colors for developing the electrostatic latent image on the latent image holding member to form a toner image; and an intermediate transfer medium onto which the thus formed toner image is to be transferred, wherein the intermediate transfer medium has a work function smaller than or equal to the work function of each of the toners, and wherein the developing devices for respective colors have been disposed so that the toner to be used first for development has the largest work function among all toners and the other toners are used in descending order of work function.

2. The image-forming apparatus of claim 1, which is a cleaner-less apparatus in which toner residues remaining untransferred on the latent image holding member are recovered in a development part.

3. The image-forming apparatus of claim 1, wherein the toners each are a nonmagnetic one-component toner.

4. The image-forming apparatus of claim 1, wherein the toners are negative electrification type toners and the developing devices are devices for reversal development.

5. The image-forming apparatus of claim 1, wherein the toners each are a nonmagnetic one-component toner and the amount thereof deposited for development on the latent image holding member is regulated to 0.5 $mg/cm^2$ or smaller.

6. The image-forming apparatus of claim 1, further comprising:

a constant-voltage power source serving as a power source for the first transfer of the toner image from the latent image holding member to the intermediate transfer medium; and a constant-current power source serving as a power source for a second transfer of the toner image from the intermediate transfer medium to a recording medium.

7. The image-forming apparatus of claim 1, wherein the toners contain at least hydrophobic silicon dioxide particles and hydrophobic titanium dioxide as flowability improvers.

8. The image-forming apparatus of claim 7, wherein the toner particles have a roundness represented by the ratio $L_0/L_1$ of 0.94 or higher, wherein $L_1$ is the length (μm) of the periphery of a projected image of each toner particle and $L_0$ is the length (μm) of the periphery of the complete circle equal in area to the projected image of the toner particle.

9. The image-forming apparatus of claim 7, wherein the toners have a number-average particle diameter of from 4.5 to 9 μm.

10. The image-forming apparatus of claim 7, wherein the toners are formed by polymerizing at least one of a monomer and an oligomer of a polymerizable organic compound in the presence of a colorant.

11. An image-forming apparatus comprising:

at least one latent image holding member on which an electrostatic latent image is to be formed;

developing devices having toners of different colors for developing the electrostatic latent image on the latent image holding member to form a toner image;

an intermediate transfer medium onto which the thus formed toner image is to be transferred; and a constant-voltage power source for supplying a transfer voltage to perform the toner image transfer onto the intermediate transfer medium, wherein the intermediate transfer medium contains an ion-conductive substance and has a work function smaller than the work function of each of the toners, and wherein the developing devices for respective colors have been disposed so that the toner to be used first for development has the largest work function among all toners and the other toners are used in descending order of work function.

12. The image-forming apparatus of claim 11, wherein the toner to be used for developing the electrostatic latent image for a first color has a work function of 5.6 eV or larger.

13. The image-forming apparatus of claim 11, wherein the ion-conductive intermediate transfer medium is a belt and the toner images transferred to the intermediate transfer medium are then transferred to paper.

14. The image-forming apparatus of claim 11, wherein the toners each are nonmagnetic one-component toner.

15. The image-forming apparatus of claim 11, wherein the amount of each toner conveyed by each developing device is 0.5 $mg/cm^2$ or smaller.

16. The image-forming apparatus of claim 11, wherein the amount of the toners to be deposited for development on the latent image holding member is 0.55 $mg/cm^2$ or smaller.

17. The image-forming apparatus of claim 11, wherein each developing device is operated at a higher peripheral speed than the latent image holding member to have a peripheral-speed ratio of the former to the latter of from 1.1 to 2.5, and the direction of movement of the latent image holding member is the same as that of the developing device at an area where the latent image holding member is closest to the developing device.

18. The image-forming apparatus of claim 11, wherein each toner has a roundness represented by the ratio $L_0/L_1$ of 0.94 or higher, wherein $L_1$ is the length (μm) of the periphery of a projected image of each toner particle and $L_0$ is the length (μm) of the periphery of the complete circle equal in area to the projected image of the toner particle.

19. The image-forming apparatus of claim 11, wherein each toner has a number-average particle diameter of from 4.5 to 9 μm.

20. The image-forming apparatus of claim 11, further comprising a constant-current power source serving as a power source for a second transfer of the toner image from the intermediate transfer medium to a recording medium.

21. The image-forming apparatus of claim 11, wherein each of the developing devices for respective colors has been united with the corresponding latent image holding member to constitute a process cartridge, and the process cartridge has been removably mounted in the image-forming apparatus.

22. The image-forming apparatus of claim 11, wherein the toners contain at least hydrophobic silica and hydrophobic titanium dioxide as flowability improvers.

* * * * *